US012703563B2

(12) United States Patent
Parker et al.

(10) Patent No.: US 12,703,563 B2
(45) Date of Patent: Aug. 11, 2026

(54) CONTAINER SYSTEM FOR PHOSPHOROUS PENTASULFIDE

(71) Applicant: PERIMETER SOLUTIONS LP, Saint Louis, MO (US)

(72) Inventors: Frank H. Parker, Saint Louis, MO (US); Robert J. Dodson, Saint Louis, MO (US); Stiles Jackson, Saint Louis, MO (US); Mark Willmore, Saint Louis, MO (US); Eric Linder, Saint Louis, MO (US); Brett Klaas, Saint Louis, MO (US); Brett Waters, Saint Louis, MO (US)

(73) Assignee: Perimeter Solutions LP, St. Louis, MO (US)

( * ) Notice: Subject to any disclaimer, the term of this patent is extended or adjusted under 35 U.S.C. 154(b) by 0 days.

(21) Appl. No.: 18/009,441

(22) PCT Filed: Aug. 13, 2021

(86) PCT No.: PCT/US2021/046003
§ 371 (c)(1),
(2) Date: Dec. 9, 2022

(87) PCT Pub. No.: WO2022/036257
PCT Pub. Date: Feb. 17, 2022

(65) Prior Publication Data

US 2023/0257191 A1 Aug. 17, 2023

Related U.S. Application Data

(60) Provisional application No. 63/065,636, filed on Aug. 14, 2020.

(51) Int. Cl.
*B65D 85/84* (2006.01)
*B65D 51/16* (2006.01)
(Continued)

(52) U.S. Cl.
CPC ..... *B65D 85/84* (2013.01); *B65D 51/16* (2013.01); *B65D 53/02* (2013.01); *B65D 55/10* (2013.01); *B65D 90/587* (2013.01)

(58) Field of Classification Search
CPC ..... B65D 53/02; B65D 55/10; B65D 85/84; B65D 90/587; B65D 45/345; B65D 51/16;
(Continued)

(56) References Cited

U.S. PATENT DOCUMENTS 697,371 A 4/1902 Sindorf
890,302 A 6/1908 Roedinger
(Continued)

FOREIGN PATENT DOCUMENTS

BR 102019013220 A2 * 1/2020 ..... A47J 27/09
CN 104939665 A * 9/2015 ..... A47J 27/08
(Continued)

*Primary Examiner* — Anthony D Stashick
*Assistant Examiner* — Marcos Javier Rodriguez Molina
(74) *Attorney, Agent, or Firm* — Harness, Dickey & Pierce, P.L.C.

(57) ABSTRACT

A container system for storage and transport of phosphorous pentasulfide. The container system can include a container body and a lid. The lid is configured to screw onto a mouth of the container body. The lid can include a lock for locking the lid in position on the mouth. The lid is configured for engagement by a tool to facilitate turning the lid to screw the lid on the mouth.

19 Claims, 27 Drawing Sheets

(51) Int. Cl.
*B65D 53/02* (2006.01)
*B65D 55/10* (2006.01)
*B65D 90/58* (2006.01)

(58) Field of Classification Search
CPC ..... B65D 1/00; B65D 1/02; B65D 1/0207; B65D 1/0215; B65D 1/0223; B65D 1/0238; B65D 1/0246; B65D 1/04; B65D 1/09; B65D 1/20; B65D 1/22; B65D 1/24; B65D 1/265; B65D 1/28; B65D 11/02; B65D 11/04; B65D 11/06; B65D 11/1873; B65D 13/02; B65D 19/0004; B65D 19/14; B65D 19/385; B65D 19/44; B65D 21/0204; B65D 21/0209; B65D 21/0213; B65D 21/0219; B65D 21/086; B65D 2203/12; B65D 2205/00; B65D 2205/02; B65D 2211/00; B65D 2231/007; B65D 2251/0015; B65D 2251/0025; B65D 2251/0031; B65D 2251/0046; B65D 2251/0056; B65D 2251/0071; B65D 2251/0087; B65D 2251/0096; B65D 2251/105; B65D 2251/20; B65D 23/003; B65D 23/10; B65D 23/12; B65D 2313/00; B65D 2313/04; B65D 2401/15; B65D 2401/20; B65D 25/02; B65D 25/04; B65D 25/10; B65D 25/22; B65D 25/24; B65D 25/2802; B65D 25/2885; B65D 25/38; B65D 25/42; B65D 25/44; B65D 25/48; B65D 25/52; B65D 25/54; B65D 2501/0081; B65D 2519/00024; B65D 2519/00029; B65D 2519/00059; B65D 2519/00169; B65D 2519/00203; B65D 2519/00273; B65D 2519/00288; B65D 2519/00293; B65D 2519/00333; B65D 2519/00338; B65D 2519/00502; B65D 2519/00532; B65D 2519/00621; B65D 2519/00666; B65D 2519/00711; B65D 2519/00761; B65D 2519/00805; B65D 2519/00815; B65D 2519/00975; B65D 2525/285; B65D 2543/00046; B65D 2543/00092; B65D 2543/00314; B65D 2543/0037; B65D 2543/00444; B65D 2543/0049; B65D 2543/00546; B65D 2543/00851; B65D 2543/00935; B65D 2543/00972; B65D 2575/586; B65D 2577/2033; B65D 2577/205; B65D 2585/6887; B65D 2588/125; B65D 2588/746; B65D 2590/0091; B65D 2590/664; B65D 2590/666; B65D 3/04; B65D 31/04; B65D 31/14; B65D 35/02; B65D 35/22; B65D 35/242; B65D 35/44; B65D 35/56; B65D 37/00; B65D 39/0023; B65D 39/08; B65D 39/14; B65D 41/02; B65D 41/04; B65D 41/0407; B65D 41/0435; B65D 41/0442; B65D 41/083; B65D 41/20; B65D 41/24; B65D 41/26; B65D 41/3428; B65D 41/3447; B65D 41/46; B65D 41/50; B65D 43/0212; B65D 43/0222; B65D 43/0229; B65D 43/0231; B65D 43/16; B65D 43/162; B65D 43/20; B65D 43/267; B65D 47/00; B65D 47/06; B65D 47/065; B65D 47/08; B65D 47/0814; B65D 47/0838; B65D 47/0842; B65D 47/0847; B65D 47/12; B65D 47/122; B65D 47/18; B65D 47/20; B65D 47/2018; B65D 47/2031; B65D 47/242; B65D 47/248; B65D 47/263; B65D 47/265; B65D 47/28; B65D 47/286; B65D 47/36; B65D 5/4208; B65D 5/722; B65D 5/746; B65D 50/00; B65D 50/04; B65D 50/048; B65D 50/06; B65D 51/002; B65D 51/145; B65D 51/18; B65D 51/20; B65D 51/222; B65D 51/226; B65D 51/228; B65D 51/24; B65D 51/249; B65D 51/28; B65D 51/2807; B65D 51/2821; B65D 51/2828; B65D 51/2835; B65D 51/2871; B65D 51/32; B65D 53/00; B65D 53/06; B65D 55/02; B65D 55/024; B65D 55/14; B65D 55/16; B65D 65/40; B65D 65/42; B65D 7/045; B65D 7/24; B65D 75/008; B65D 75/12; B65D 75/32; B65D 75/366; B65D 75/5838; B65D 75/5866; B65D 75/5872; B65D 75/5877; B65D 75/5883; B65D 77/02; B65D 77/04; B65D 77/0406; B65D 77/0426; B65D 77/0493; B65D 77/067; F16K 3/0227; F16K 3/0281; F16K 3/316; Y10S 292/27; Y10S 220/908; Y10S 220/912; Y10T 292/212; Y10T 292/216; Y10T 137/8803; Y10T 137/88038; Y10T 29/49417; Y10T 292/205
USPC .... 220/293, 1.5, 1.6, 203.09, 211, 212, 229, 220/23.4, 23.6, 23.8, 23.83, 23.89, 23.91, 220/234, 235, 238, 252, 253, 254.3, 220/254.6, 254.8, 254.9, 255, 262, 263, 220/264, 268, 270, 314, 315, 319, 320, 220/321, 323, 324, 345.1, 345.2, 345.6, 220/351, 364, 378, 4.12, 4.27, 4.33, 4.34, 220/495, 495.01, 500, 506, 523, 524, 555, 220/562, 592.18, 592.2, 592.28, 6, 601, 220/62.18, 669, 675, 740, 752, 810, 835, 220/839, 87.1, 9.4, 908, 908.1, 911, 220/DIG. 33, 265, 288, 303, 33; 251/293, 326, 327, 328, 358, 360, 193, 251/212, 25, 335.3, 163, 264, 329; 292/256.65, DIG. 27; 34/174, 182, 210, 34/218, 230, 232, 233, 235, 509, 510, 34/521, 58, 582, 592, 60, 68; 206/7, 1.5, 206/204, 205, 242, 256, 265, 268, 269, 206/308, 308.3, 335, 338, 364, 366, 370, 206/372, 380, 382, 386, 387.13, 389, 390, 206/393, 408, 409, 445, 454, 459.1, 206/459.5, 468, 484.1, 503, 508, 509, 206/511, 512, 521, 524.4, 524.8, 528, 206/531, 539, 540, 55, 564, 576, 587, 206/594, 598, 599, 600, 701, 702, 710, 206/759, 818, 820, 822; 414/221; 49/279; 222/608
See application file for complete search history.

(56) References Cited

U.S. PATENT DOCUMENTS

| | | | |
|---|---|---|---|
| 1,598,870 | A | 9/1926 | Merry |
| 3,746,206 | A | 7/1973 | Utz |
| 4,175,781 | A | 11/1979 | Dumortier |
| 4,334,630 | A | 6/1982 | Bergin |
| 5,072,850 | A | 12/1991 | Gagnon et al. |

(56) References Cited

U.S. PATENT DOCUMENTS

| | | | | | |
|---|---|---|---|---|---|
| 5,224,635 | A * | 7/1993 | Wise | B62B 5/0083 | 206/508 |
| 5,251,776 | A | 10/1993 | Morgan, Jr. et al. | | |
| 5,322,177 | A * | 6/1994 | Coggings | B65D 1/20 | 220/240 |
| 5,353,944 | A * | 10/1994 | Davis | B60P 3/226 | 220/601 |
| 5,634,566 | A | 6/1997 | Jansen et al. | | |
| 5,913,908 | A | 6/1999 | Czipri | | |
| 10,472,169 | B1 * | 11/2019 | Parker, Jr. | F16K 3/0281 | |
| 2002/0030054 | A1 * | 3/2002 | Boulange | B65D 39/0023 | 220/265 |
| 2003/0222237 | A1 * | 12/2003 | Maenishi | F16L 55/124 | 251/334 |
| 2004/0178200 | A1 | 9/2004 | Langlois et al. | | |
| 2008/0110906 | A1 | 5/2008 | Thompson | | |
| 2010/0025396 | A1 | 2/2010 | Boake | | |
| 2011/0220828 | A1 * | 9/2011 | Kennedy | F16K 3/0218 | 251/328 |
| 2018/0208394 | A1 * | 7/2018 | Erren | B65D 90/582 | |
| 2020/0200281 | A1 * | 6/2020 | Fee | F16K 3/0227 | |
| 2021/0188495 | A1 | 6/2021 | Parker, Jr. et al. | | |

FOREIGN PATENT DOCUMENTS

| | | | | |
|---|---|---|---|---|
| CN | 210661337 U * | 6/2020 | | |
| DE | 102016125305 A1 * | 12/2017 | F01P 11/029 | |
| JP | 2009096471 A * | 5/2009 | B67D 1/07 | |
| KR | 100191470 B1 * | 6/1999 | | |

* cited by examiner

CONTAINER SYSTEM FOR PHOSPHOROUS PENTASULFIDE

CROSS-REFERENCE TO RELATED APPLICATIONS

The present application is a U.S. national stage filing under 35 U.S.C. § 371 of International Application No. PCT/US2021/046003, which has an international filing date of Aug. 13, 2021, which claims the benefit of, and priority to, U.S. Provisional Application No. 63/065,636, filed on Aug. 14, 2020. The entire disclosure of each of the above-referenced applications is incorporated herein by reference.

FIELD

The present disclosure generally relates to material storage and transport containers, and more particularly to a lid for a phosphorous pentasulfide container.

BACKGROUND

A container or bin for storing phosphorous pentasulfide includes a valve for opening and closing a fill/dispense port of the bin and a mouth for filling and dispensing the phosphorous pentasulfide. The mouth may be part of a valve, such as a gate valve, for opening and closing the mouth of the bin. This type of bin is often re-used many times to deliver multiple loads of phosphorous pentasulfide to the same or various customers. The valve is opened at the supplier to install phosphorous pentasulfide in the bin. After the bin is filled with phosphorous pentasulfide at the supplier, the supplier closes the valve and covers the mouth of the bin with a lid. After the valve is closed, the bin is delivered to the customer. The customer opens the valve to dispense the phosphorous pentasulfide as desired. If possible, the customer closes the valve, reattaches the lid, and returns the bin empty to the supplier. The bins and their valves are subject to harsh conditions due to the nature of the phosphorous pentasulfide, fluctuations in weather, and rough treatment by some personnel opening and closing the valves. Conventional valves do not last long in the field before requiring maintenance and/or repair. Phosphorous pentasulfide is generally hazardous and should be well contained. Valve and lid malfunction and maintenance can subject workers to undesired exposure to phosphorous pentasulfide. Moreover, phosphorous pentasulfide reacts with water to form hydrogen sulfide, sulfur dioxide, and phosphoric acid. Conventional lids are bulky and are time consuming and challenging to attach to and remove from the bin.

SUMMARY

In one aspect, a container system comprises a container body, a mouth, a valve, and a lid. The container body comprises an interior sized and shaped to hold the phosphorous pentasulfide. The mouth is supported by the container body and defines a mouth opening for communication with the interior of the container body. The valve is supported by the container body and is selectively openable to permit communication between the mouth and the interior of the container body. The valve is selectively closeable to block communication between the mouth and the interior of the container body. The lid is configured to close the mouth. The lid is configured to screw onto the mouth to connect the lid and mouth to close the mouth to block the mouth opening.

In another aspect, a lid for a phosphorous pentasulfide container comprises a cover and a circumferential wall extending from the cover. The wall has an inner surface. A plurality of catches extend radially inward from the inner surface of the wall. The catches are circumferentially spaced apart on the wall.

In another aspect, a container system for holding a material comprises a container having an interior sized and shaped to hold the material. The container has a mouth defining a generally circular opening for communication with the interior. A lid is sized and shaped to cover the opening. A closure is configured to releasably connect the lid and the mouth. The closure includes a plurality of retainers circumferentially arranged on one of the mouth or the lid. The retainers are circumferentially spaced apart to define a plurality of gaps. Each gap is disposed between adjacent retainers. The closure includes a plurality of catches circumferentially arranged on the other one of the mouth or the lid. Each catch is arranged to pass through one of the gaps to mount the lid on the mouth and arranged to engage one of the retainers when the lid is rotated relative to the mouth to secure the lid to the mouth. The catches and gaps each have an asymmetrical circumferential arrangement;

In yet another aspect, a mouth for a container comprises a base and a circumferential wall extending from the base. The wall has an outer surface and an inner surface. The inner surface defines a mouth opening. The mouth includes a plurality of retainers circumferentially arranged on the outer surface of the wall. The retainers are circumferentially spaced apart to define gaps between adjacent retainers.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
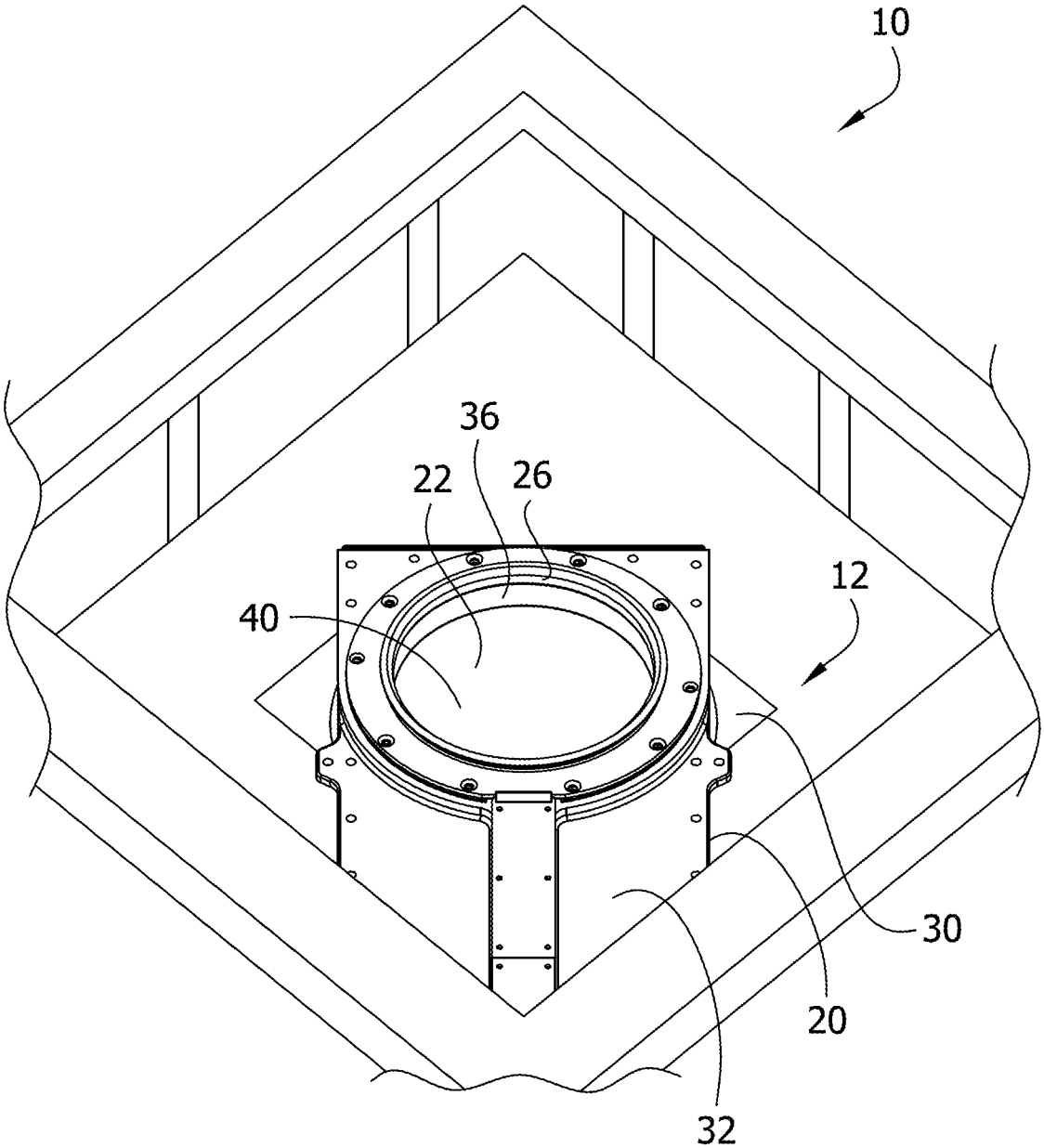
FIG. 1 is a top, front fragmentary perspective of a container embodying aspects of the present invention, the container including a valve shown in a closed configuration.

Referring to FIG. 1, a bin or container 10 embodying aspects of the present invention can include a non-rising stem gate valve (broadly, "valve" or "gate valve") indicated generally by the reference number 12. The bin 10 can be used for storing and/or transporting various materials, such as solids or liquids. In one example, the bin 10 can be used to hold an oil additive known as phosphorous pentasulfide, a crystalline solid powder. It will be appreciated that the bin 10 could be used for other purposes (e.g., carrying other materials). Moreover, the valve 12 could be used on other apparatus, and aspects of the valve could be used in other types of valves, without departing from the scope of the present invention.

Figure 2:
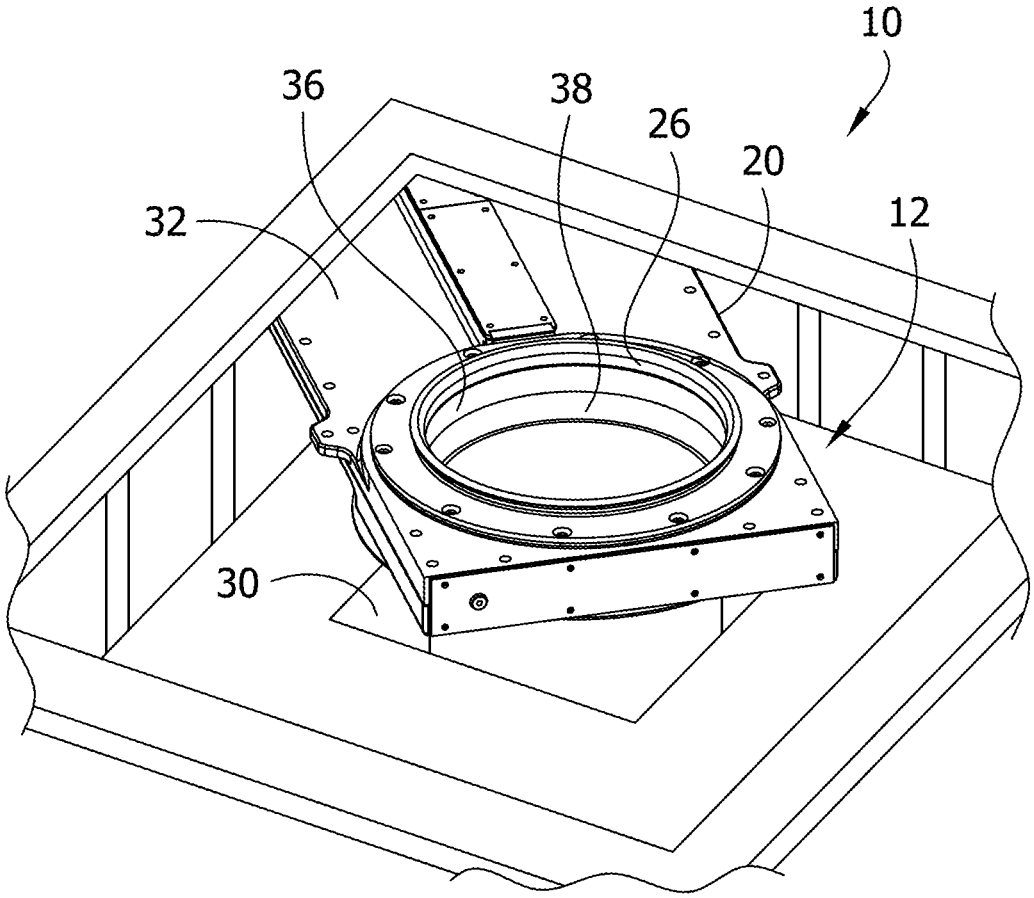
FIG. 2 is a top, rear fragmentary perspective of the container of FIG. 1, showing the valve in an open configuration.
Figure 3:
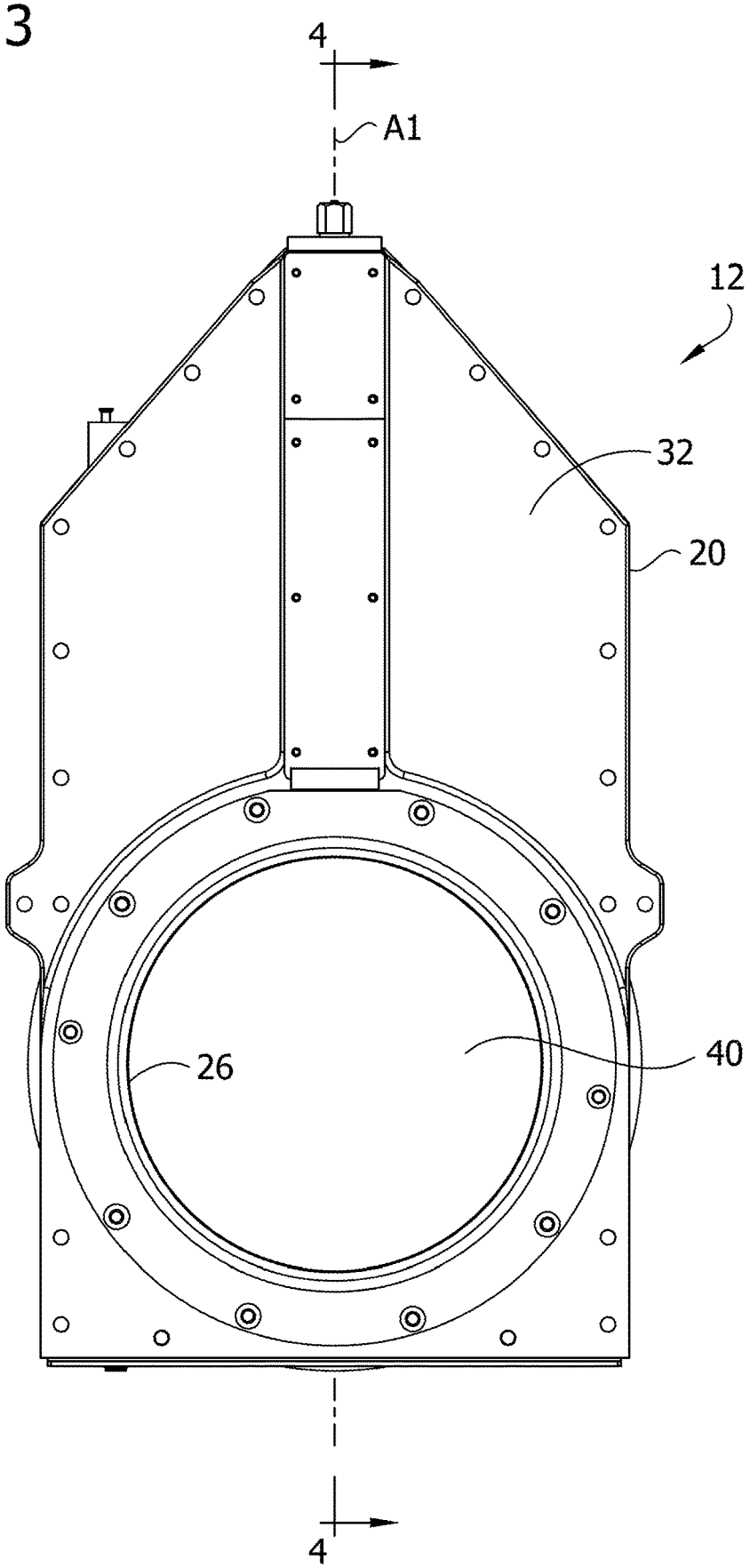
FIG. 3 is a front elevation of the valve.
Figure 5:
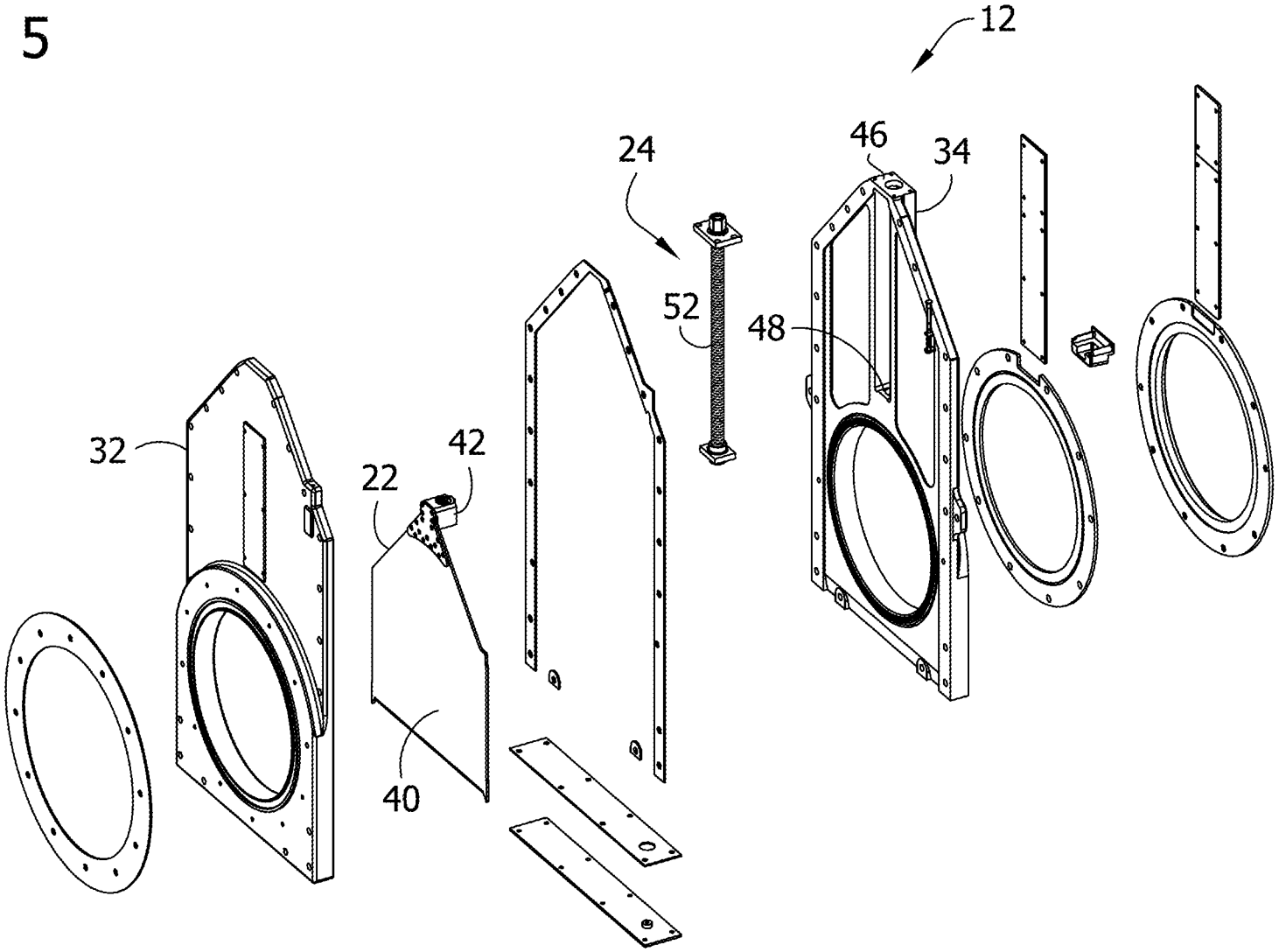
FIG. 5 is an exploded view of the valve.

The valve 12 is shown in a closed configuration in FIG. 1 and in an open configuration in FIG. 2. An exploded view of the valve 12 is shown in FIG. 5. The valve generally includes a valve housing 20, a gate 22 movable in the valve housing, and a drive assembly 24 for moving the gate in the valve housing between closed and open positions. The valve housing 20 defines a generally circular valve port 26 through which phosphorous pentasulfide can be installed into the bin 10 and/or dispensed from the bin. For example, the bin can be oriented such that the port 26 faces upward for filling the bin 10, and the bin can be oriented such that the port faces to the side or downward for emptying the bin. In FIGS. 1 and 2, the port 26 is facing upward for filling the bin 10. The valve housing 20 is connected to a neck of the bin leading to a body 30 of the container defining an interior in which product can be stored. The valve port 26 provides access to the interior of the bin.

In the illustrated embodiment, the valve housing 20 includes an outer shell 32 and an inner shell 34. The outer and inner shells 32, 34 can be made of cast and/or machined aluminum. The shells 32, 34 have respective circular openings that form the valve port 26 when the shells are secured to each other. Desirably, sealing rings 36, 38 are mounted on the inner and outer shells 32, 34 to surround the circular openings and to seal against each other when the shells are secured to each other to form a seal around the valve port 26 to prevent ingress of phosphorous pentasulfide or water into the valve housing 20 be the shells. When the gate 22 is in the closed position, the gate closes the valve port and extends between the sealing rings 36, 38. The drive assembly 24 is configured to slide the gate 22 between the sealing rings 36, 38 to open and close the valve port 26.

Figure 4:
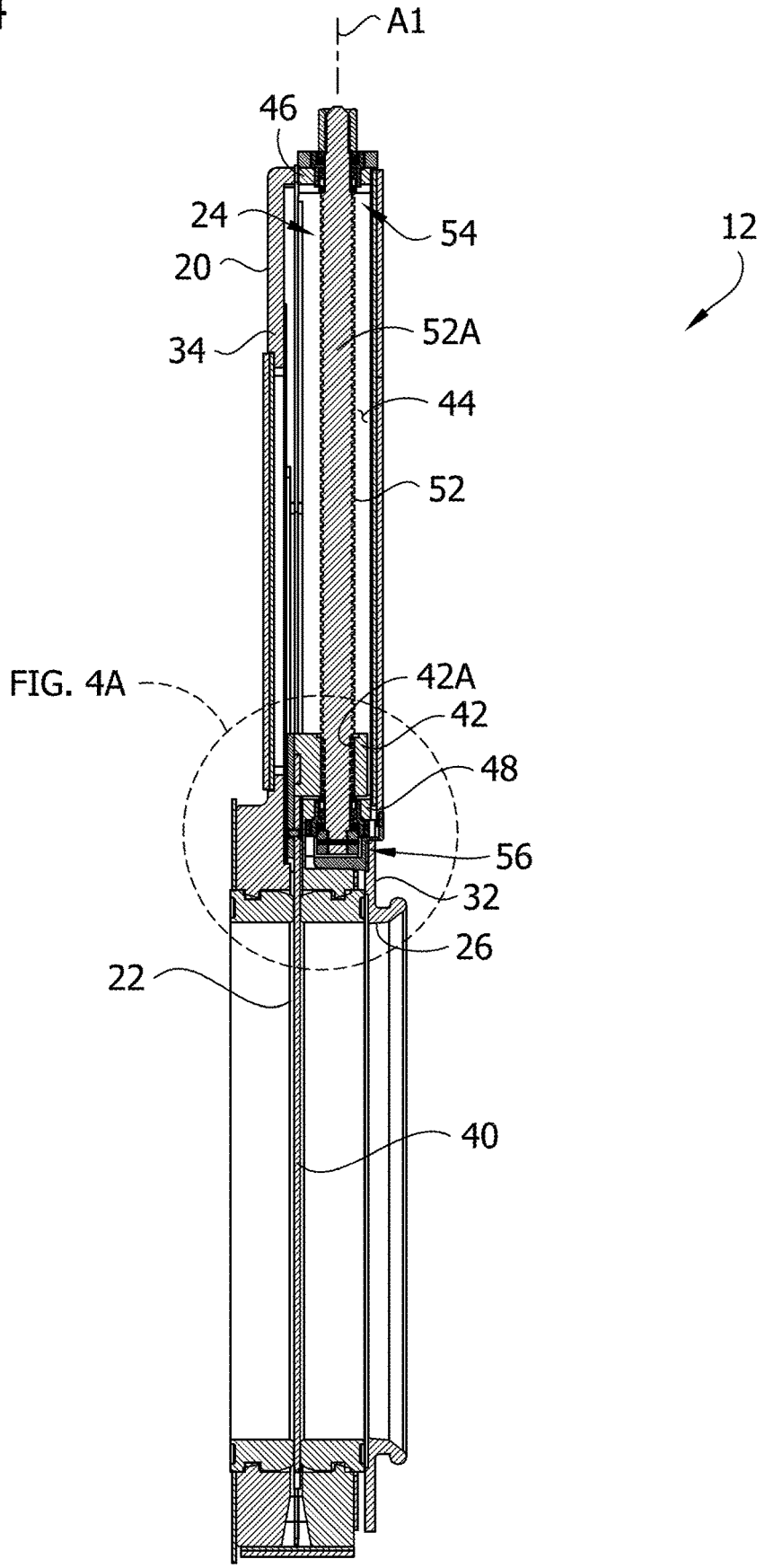
FIG. 4 is a section of the valve taken in a plane including line 4-4 of FIG. 3.
Figure 4A:
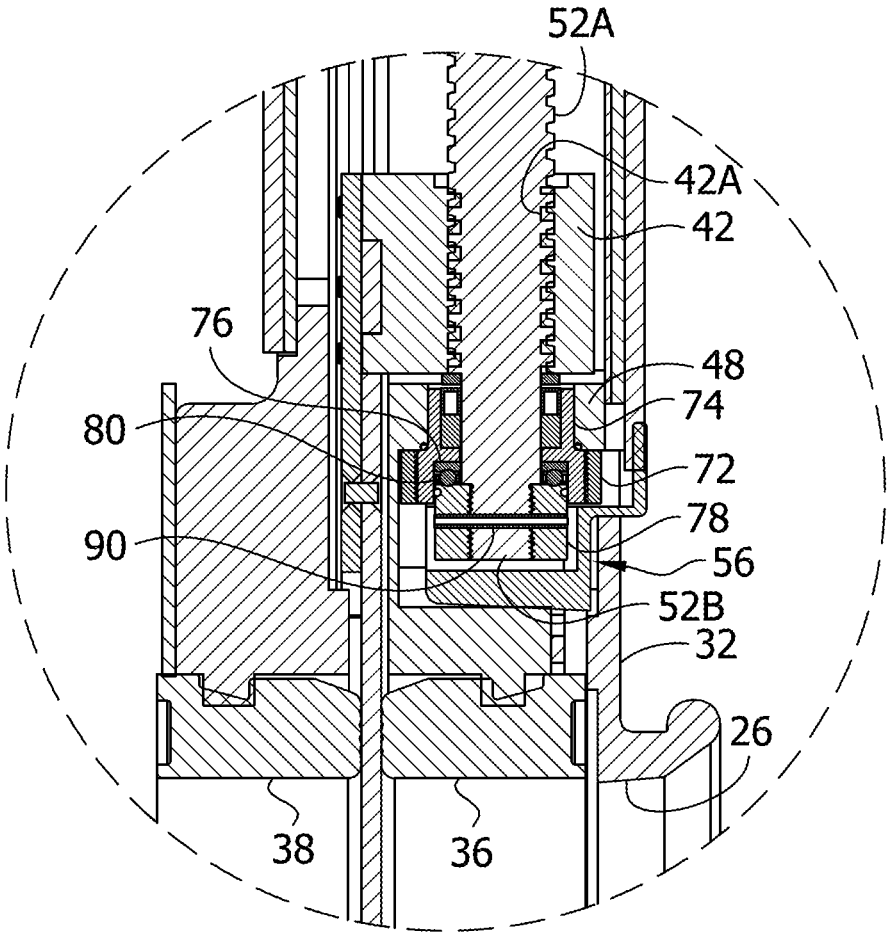
FIG. 4A is an enlarged view of a portion of FIG. 4.

As shown in FIGS. 4 and 5, the gate 22 includes a generally flat gate body 40 and a follower 42. The gate body 40 is sized and shaped to slide between the sealing rings 36, 38 and to close the valve port 26 when the gate 22 is in the closed configuration. The follower 42 is secured to an upper end of the gate body 40 and includes a threaded opening 42A for threaded connection to the drive assembly 24, as will become apparent.

As shown in FIG. 4, the valve housing 20 defines an elongate cavity 44 in which the drive assembly 24 is partially housed and in which the gate follower 42 is movable to open and close the valve port 26. The housing 20 includes an upper web 46 at an upper end of the elongate cavity and a lower web 48 at a lower end of the elongate cavity. The drive assembly 24 is mounted to, supported by, and extends between the upper and lower webs 46, 48 when the drive assembly is installed in the housing 20. The gate follower 42 engages the upper web 46 when the gate is fully raised (open) and engages the lower web 48 when the gate is fully lowered (closed), as shown in FIG. 4. The upper and lower webs 46, 48 can be broadly referred to as follower stops and bearing assembly supports.

Figure 6:
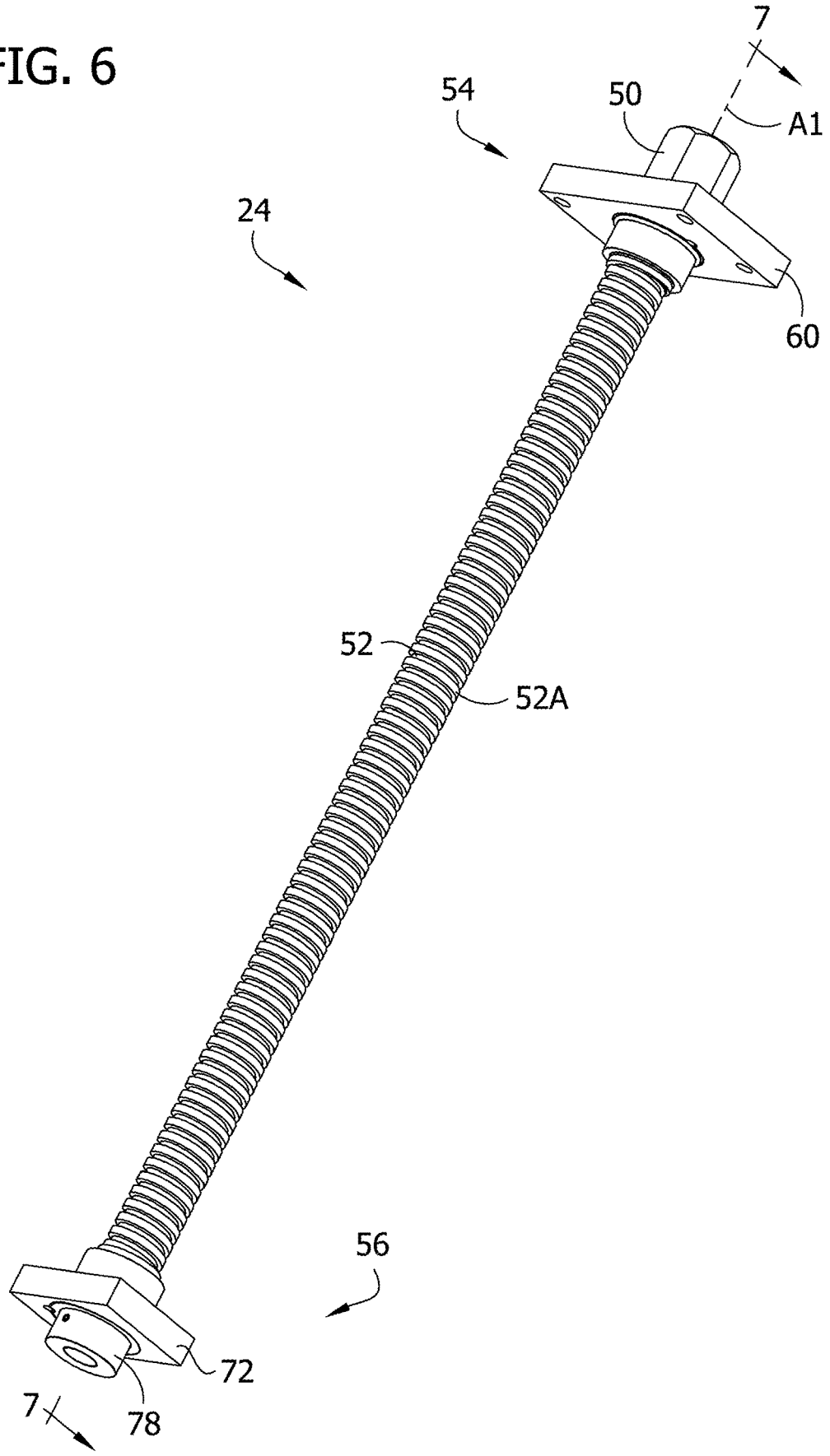
FIG. 6 is a perspective of a drive assembly of the valve.
Figure 7:
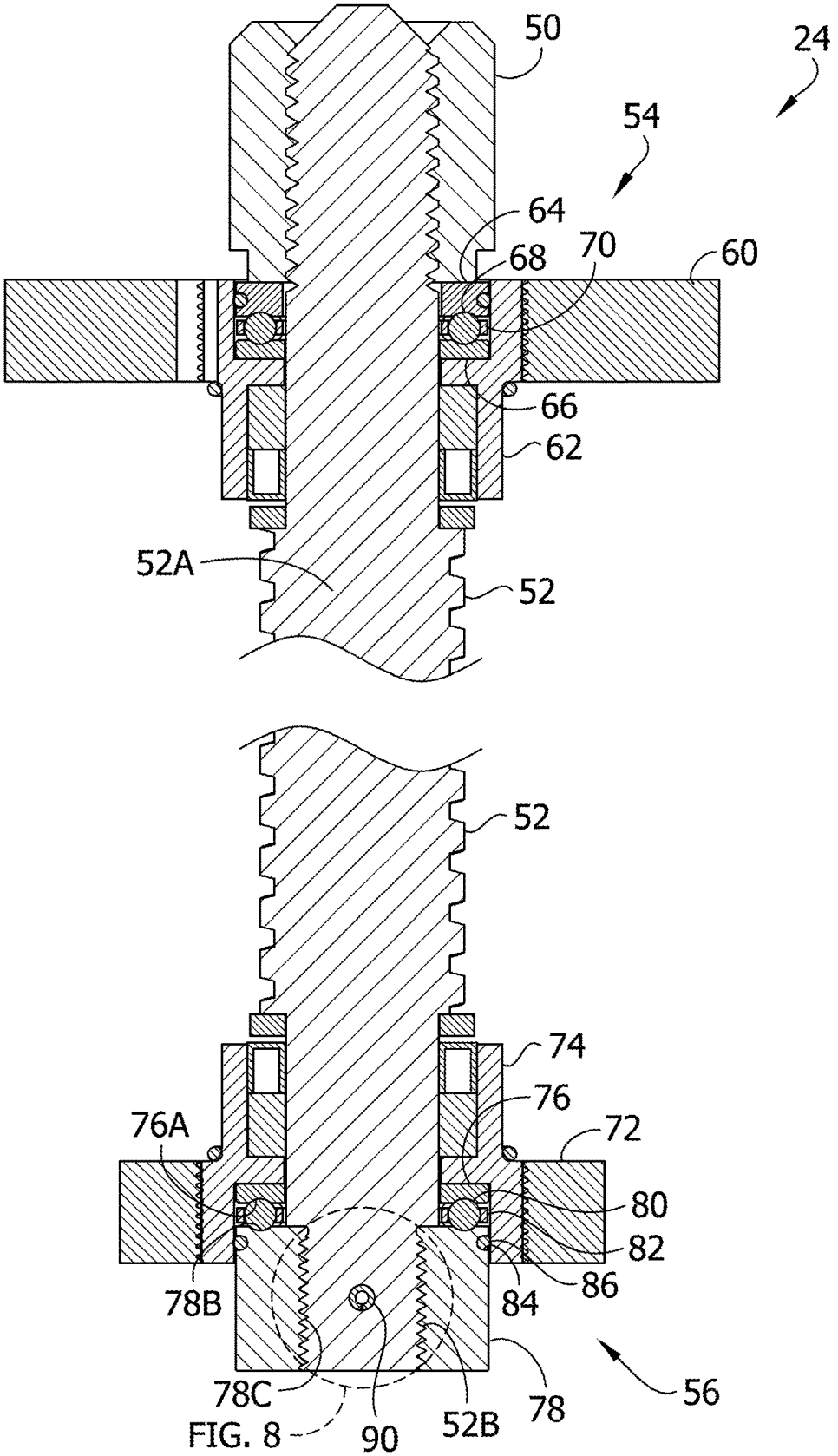
FIG. 7 is a section of the drive assembly taken in a plane including line 7-7 of FIG. 6.
Figure 8:
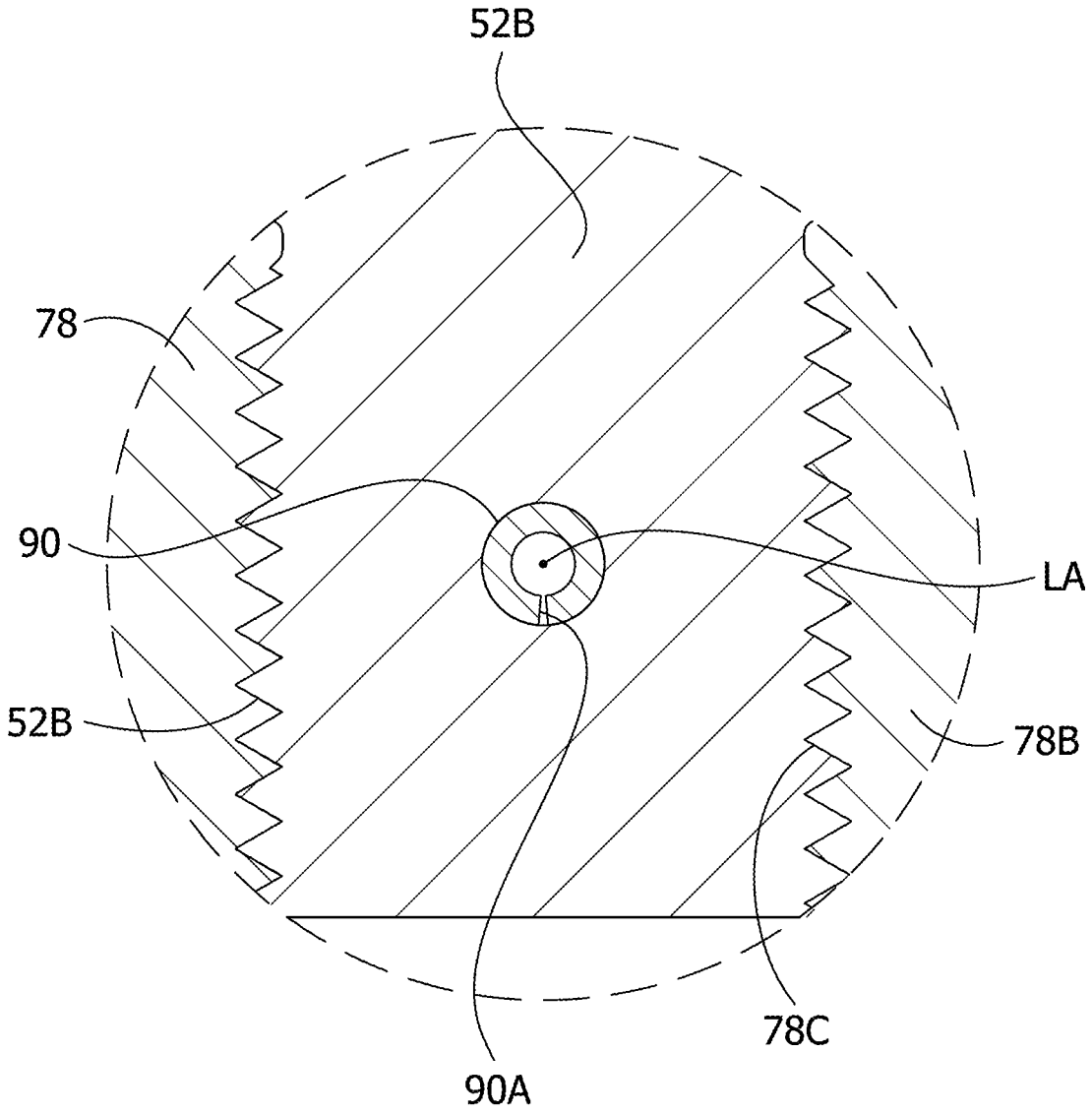
FIG. 8 is a partial view of the section of FIG. 7 showing a roll pin in closer detail.
Figure 9:
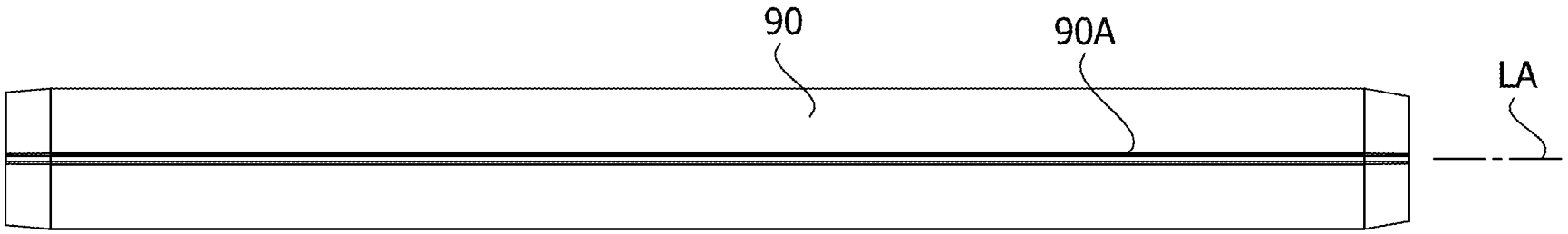
FIG. 9 is a side elevation of the roll pin.
Figure 10:
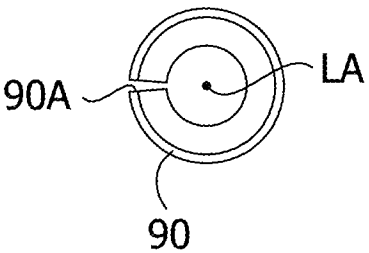
FIG. 10 is an end view of the roll pin.
Figure 11:
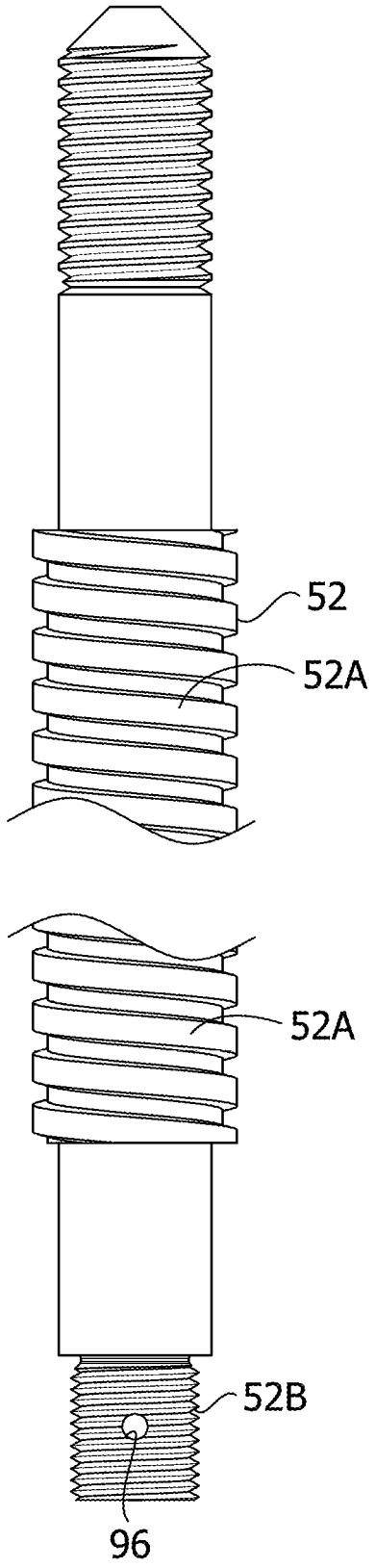
FIG. 11 is a side elevation of a drive shaft of the drive assembly.
Figure 12:
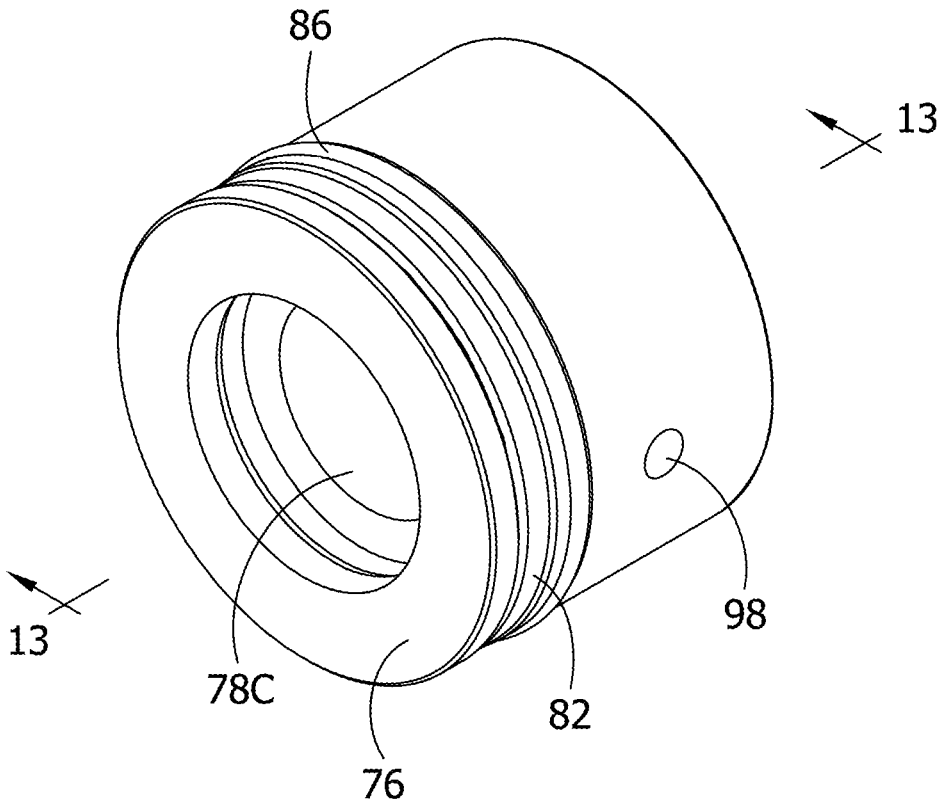
FIG. 12 is a perspective of a non-drive-end bearing assembly of the drive assembly.
Figure 13:
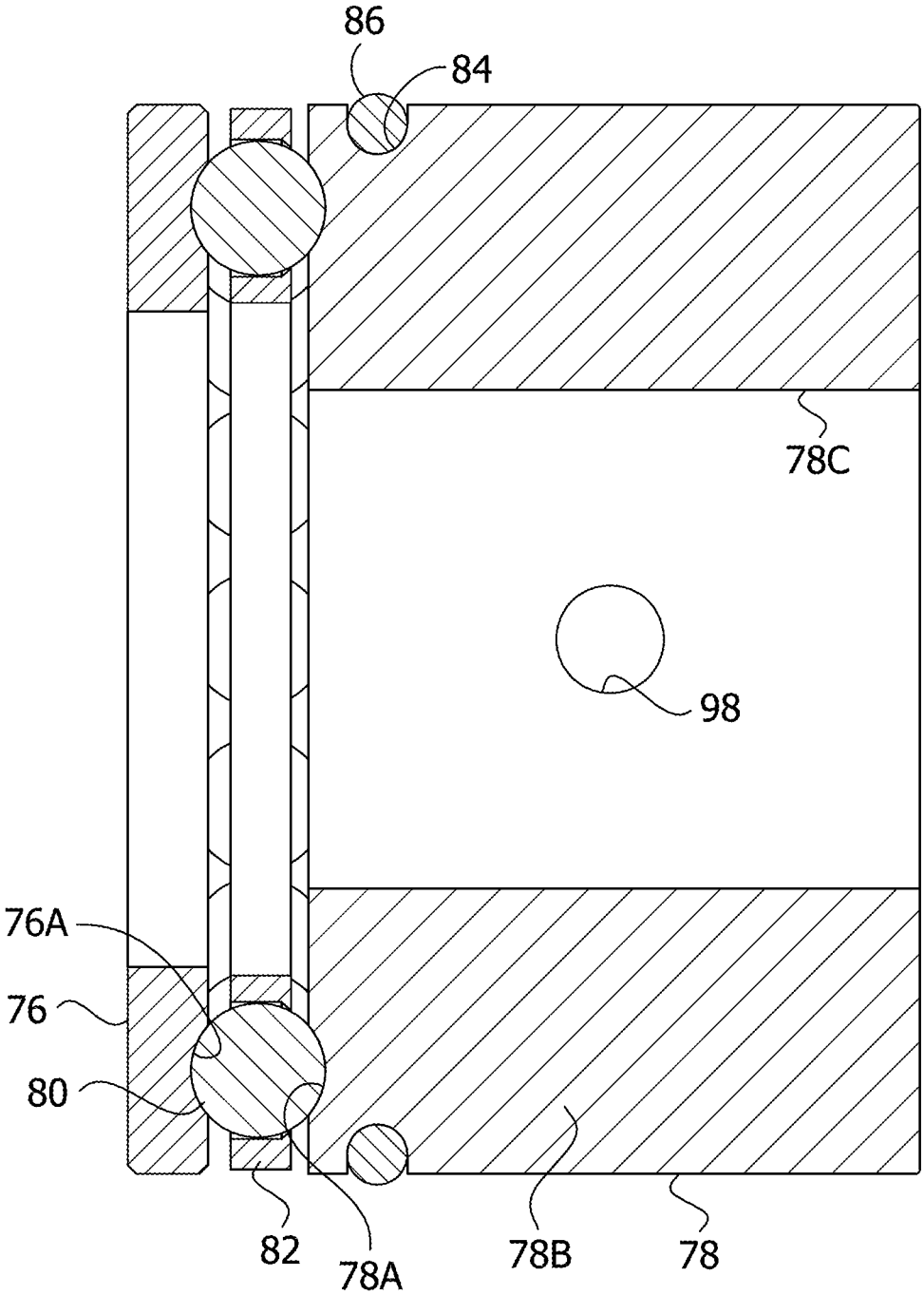
FIG. 13 is a section of the non-drive-end bearing assembly taken in a plane including line 13-13 of FIG. 12.
Figure 14:
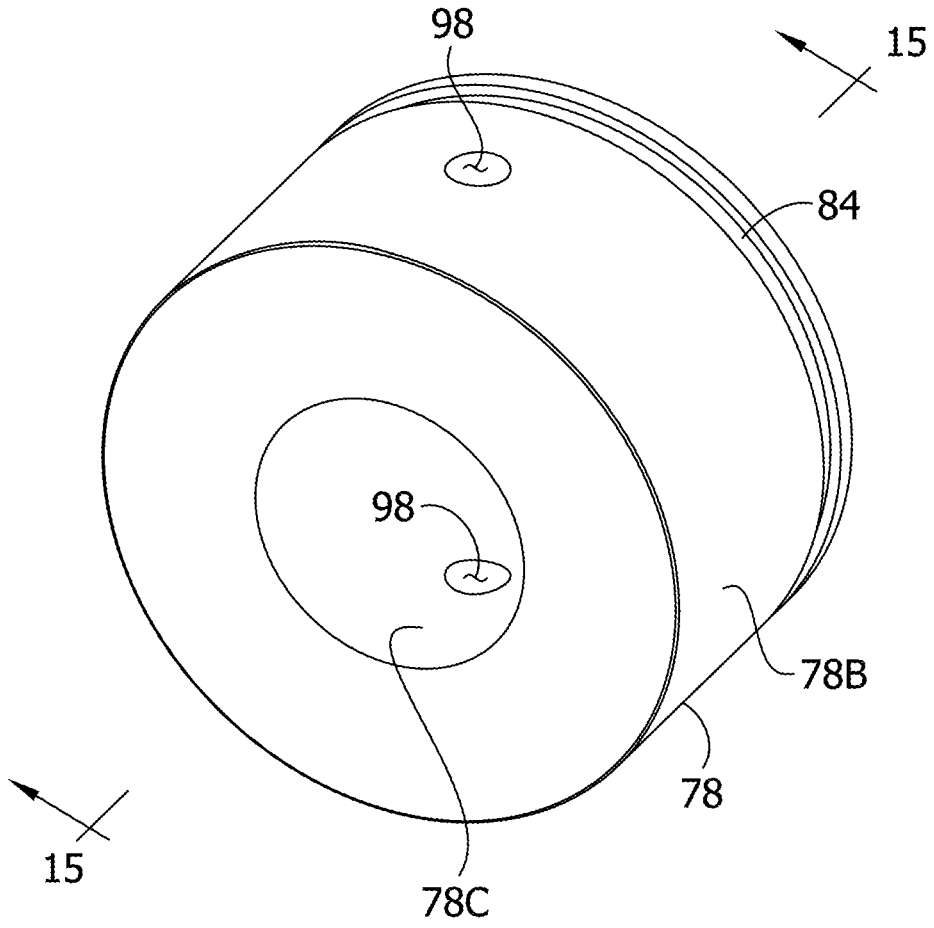
FIG. 14 is a perspective of a threaded bearing race of the bearing assembly of FIG. 12.

Referring to FIG. 6, the drive assembly 24 has a drive end (to the top as viewed in FIG. 6) and a non-drive end (to the bottom as viewed in FIG. 6). When the drive assembly 24 is installed in the housing 20, the drive end extends out of the housing and is exposed outside the housing for actuating the gate valve 12. In particular, a nut 50 threaded onto and welded to a top end of a drive shaft 52 is exposed outside the housing 20 for engagement by a nut setter or other tool. The drive shaft 52 is shown as a unitary component, but it will be understood that separate shaft members could be connected together to form the drive shaft without departing from the scope of the present invention. The drive assembly 24 includes a drive-end thrust bearing assembly 54, and a non-drive-end thrust bearing assembly 56 that support respective ends of the drive shaft 52. The drive shaft 52 includes an intermediate portion 52A that has an ACME thread on which the gate follower 42 is threaded when the valve is assembled. The drive shaft 52 is rotatable about an axis of rotation A1 extending between the thrust bearing assemblies 54, 56. Rotation of the shaft 52 in a first direction (e.g., clockwise) drives the gate follower 42 downward (toward the port), and rotation of the shaft in a second direction (e.g., counter-clockwise) opposite the first direction drives the gate follower upward (away from the port).

Desirably, the gate valve 12 is configured such that the gate 22 is movable toward the open and closed positions by application of rotational force (e.g., to the drive shaft 52 via the top nut 50) of less than 60 ft-lbs, more desirably less than 50 foot-lbs, more desirably less than 40 ft-lbs, and even more desirably less than 30 ft-lbs (e.g., about 25 ft-lbs). In testing of a prototype of the illustrated valve 12, the rotational force required to move the gate was about 17 ft-lbs.

The drive-end thrust bearing assembly 54 includes an anti-rotation mount or plate 60, a bearing housing 62 threaded in the mount, an upper bearing race 64, a lower bearing race 66, a plurality of ball bearings 68 (e.g., 16 ball bearings), and a cage 70 separating the ball bearings from one another.

The non-drive-end thrust bearing assembly 56 includes an anti-rotation mount or plate 72, a bearing housing 74 threaded in the mount, an upper bearing race 76, a lower bearing race 78, a plurality of ball bearings 80 (e.g., 16 ball bearings), and a cage 82 separating the ball bearings from one another. The upper and lower races 76, 78 include respective annular race tracks 76A, 78A on which the ball bearings 80 roll around the axis of rotation. The lower race 78 includes a race track support body 78B configured to provide robust support to the race track 78A. In the illustrated embodiment, the lower race 78 is a unitary component in which the race track 78A and race track support body 78B are formed integrally of the same piece of material (e.g., by machining a blank of material). The race track 78A is defined by an annular surface on the upper end of the race track support body 78B. However, it will be appreciated that the race track 78A and race track support body 78B could be formed of separate pieces of material and movable (e.g., rotatable) with respect to each other without departing from the scope of the present invention. For example, the lower race could include a collar and a washer separate from the collar, the washer defining the race track, and the collar defining the race track support body.

In the illustrated embodiment, the ball bearings 80 and annular tracks are sized such that the ball bearings engage the annular tracks 76A, 76B along relatively large semicircular surface segments of the ball bearings. However, non-recessed race tracks can be used without departing from the scope of the present disclosure.

The lower bearing race 78 desirably has a seal with the bearing housing 74. In the illustrated embodiment, the race track support body 78B has an outer annular recess 84. The annular recess holds a gasket (e.g., O-ring) 86 for forming a seal with an inside of the bearing housing 74.

In a particularly advantageous aspect of the gate valve 12, the non-drive-end bearing assembly 56 is configured to withstand a potential mode of failure in which the gate valve is "dead headed" by closing the valve and continuing to rotate the drive shaft 52. For example, although not recommended, some users may actuate the drive assembly 24 by engaging an impact wrench (e.g., ¾" impact wrench carrying an appropriate socket) with the nut at the upper end of the drive assembly. The user may do this to overcome difficulty in closing the valve due to phosphorous pentasulfide powder blocking closure of the gate. Before the user realizes the valve 12 is fully closed, the user may continue to rotate the drive shaft 52 by applying high torque via the impact wrench. When the gate follower 42 is in engagement with the lower web 48, further rotation of the drive shaft 52 tending to drive the follower farther downward will cause the drive shaft to attempt to pull the lower bearing assembly 56 upward through the opening in the lower web 48. The result is application of substantial thrust force (force parallel to the axis of rotation) to the lower bearing assembly 56.

Figure 15:
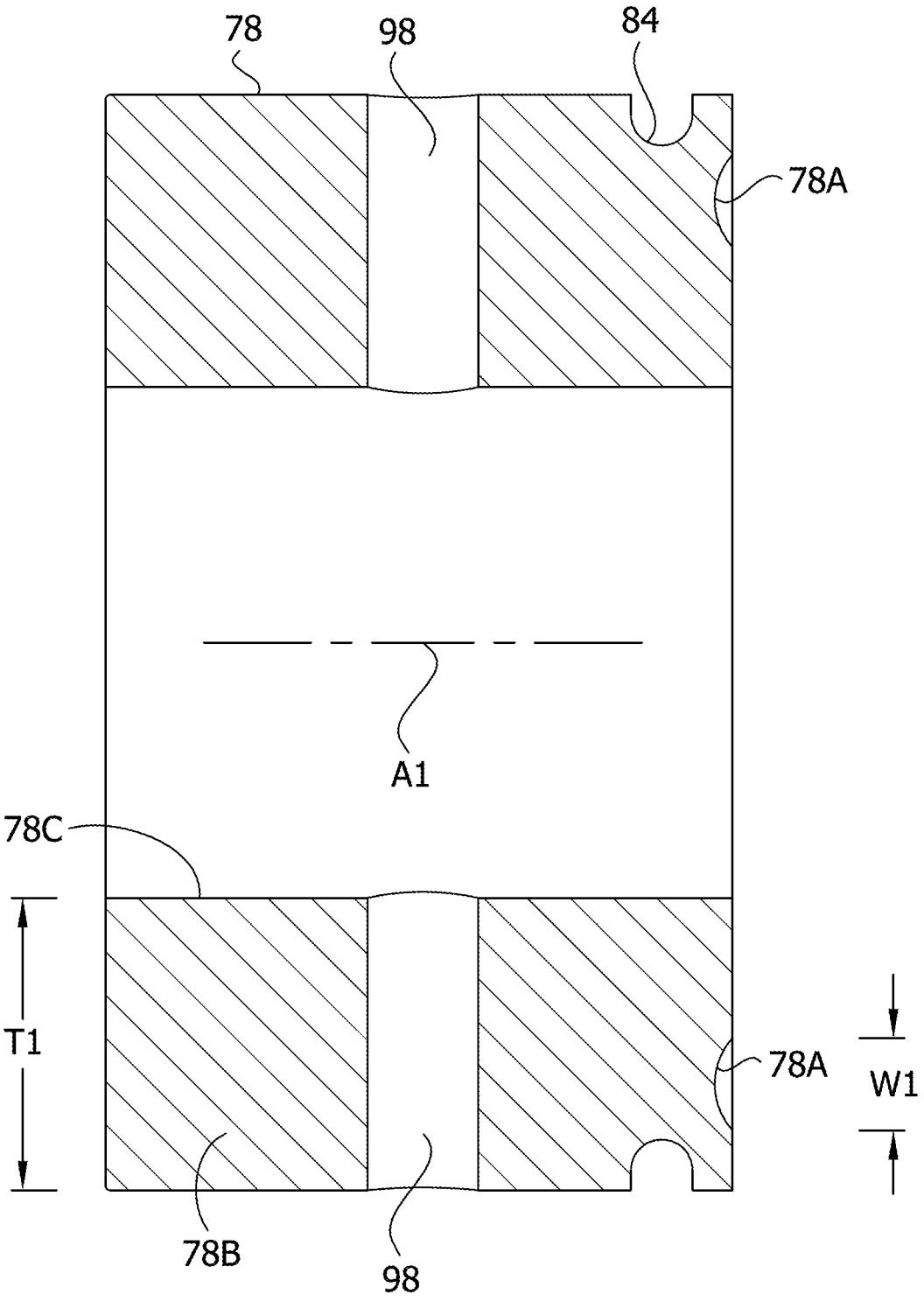
FIG. 15 is a section of the threaded bearing race taken in a plane including line 14-14 of FIG. 14.

To provide resistance to damage when the gate valve 12 is dead-headed, the lower race 78 of the non-drive-end bearing assembly 56 is threaded to the lower end of the drive shaft 52, is secured to the drive shaft by a roll pin 90 for conjoint rotation with the drive shaft, and has a relatively robust construction. Any one or more of these features, or combinations or variations thereof, can be used without departing from the scope of the present invention. The lower end of the drive shaft 52 has a suitably threaded portion 52B (e.g., ⅝"-18) (desirably, a coarse thread) and the lower race 78 has a corresponding threaded opening 78C. The threading of the lower race 78 to the drive shaft 52 provides substantial engagement surface area of the lower race with the drive shaft. This assists the lower race 78 in maintaining its position on the drive shaft 52 and transferring thrust force to the drive shaft over a relatively large surface area via the threaded engagement when the drive shaft is subjected to substantial thrust force tending to force the upper race 76 toward the lower race 78. The roll pin 90 extends through a transverse bore 96 in the drive shaft 52 and has ends extending in aligned opposite openings 98 in the lower race 78. The roll pin 90 prevents the lower race 78 from unthreading from the drive shaft 52 and assists in resisting thrust force applied to the lower race. Desirably, the roll pin 90 is installed such that an elongate gap 90A extending longitudinally in the wall of the roll pin and facing radially away from a longitudinal axis LA of the roll pin faces along or codirectional with the axis of rotation A1, not transverse to the axis of rotation, such that the gap does not tend to reduce by compression of the roll pin under the thrust forces. The lower race 78 has a particularly robust construction in that the race is relatively thick and tall, making the lower race less likely to crack or otherwise break when under substantial thrust force. The robustness of the race track support body 78B can be described by reference to a width W1 (FIG. 15) of the race track 78A extending radially with respect to the axis of rotation A1. The race track support body 78B as an intermediate section spaced along the axis A1 away from the race track 78A having a thickness T1 (FIG. 15) that is at least as great as the width W1 of the race track 78A. In the illustrated embodiment, the thickness T1 is greater than the width W1, and the thickness is such that an outer surface of the race track support body 78A extending around the axis A1 is radially outboard of the race track 78A. The thickness of the lower race 78 is carried downward from the upper surface of the race to the lower surface of the lower race. The construction of the lower race 78 and connection of the lower race increases the structural integrity of the bearing assembly 56 and renders the bearing assembly less likely to break when the valve is dead-headed.

Bins or containers including gate valves of the type described herein have been subjected to field testing and have been found to withstand harsh operating conditions. In particular, a previous point of failure was damage to components of the lower thrust bearing assembly when the user continued rotating the drive shaft tending to drive the gate further downward when the gate was bottomed out with the follower in engagement with the lower web of the housing. However, the construction of the lower thrust bearing described herein has been found to withstand substantial abuse without breaking. The lower race and connection of the lower race to the drive shaft is believed to result in a particularly robust construction that is able to withstand high thrust forces of "dead-heading" the gate valve. In testing, a lower race as shown and described herein remained undamaged after dead-heading the gate valve and applying torque up to 276 ft-lbs to the drive shaft via the nut 50. Prior bearings started exhibiting damage at less than 100 ft-lbs.

Figure 16:
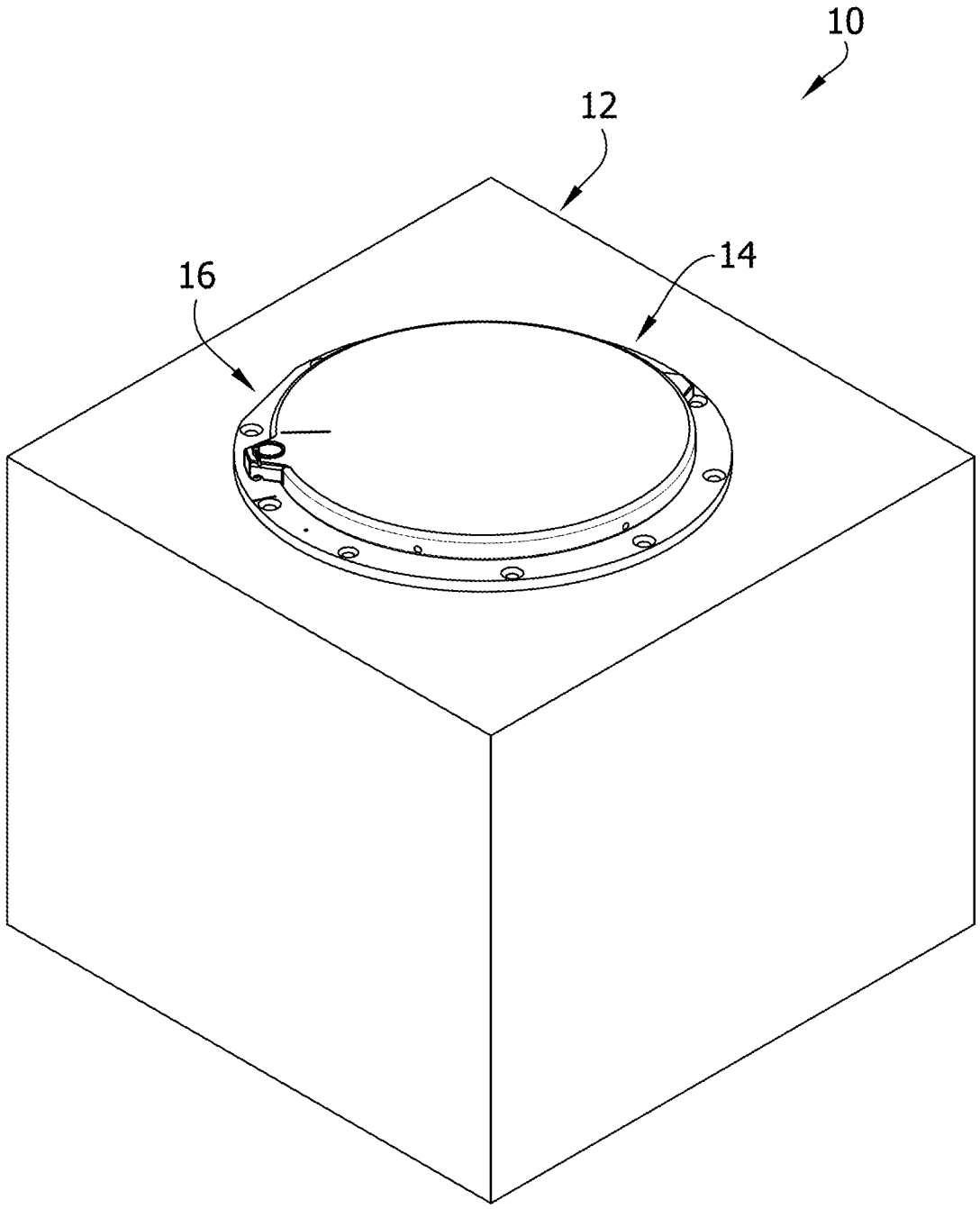
FIG. 16 is a perspective of a container system according to one embodiment of the present disclosure; the container system including a lid and a container with a mouth.
Figure 17:
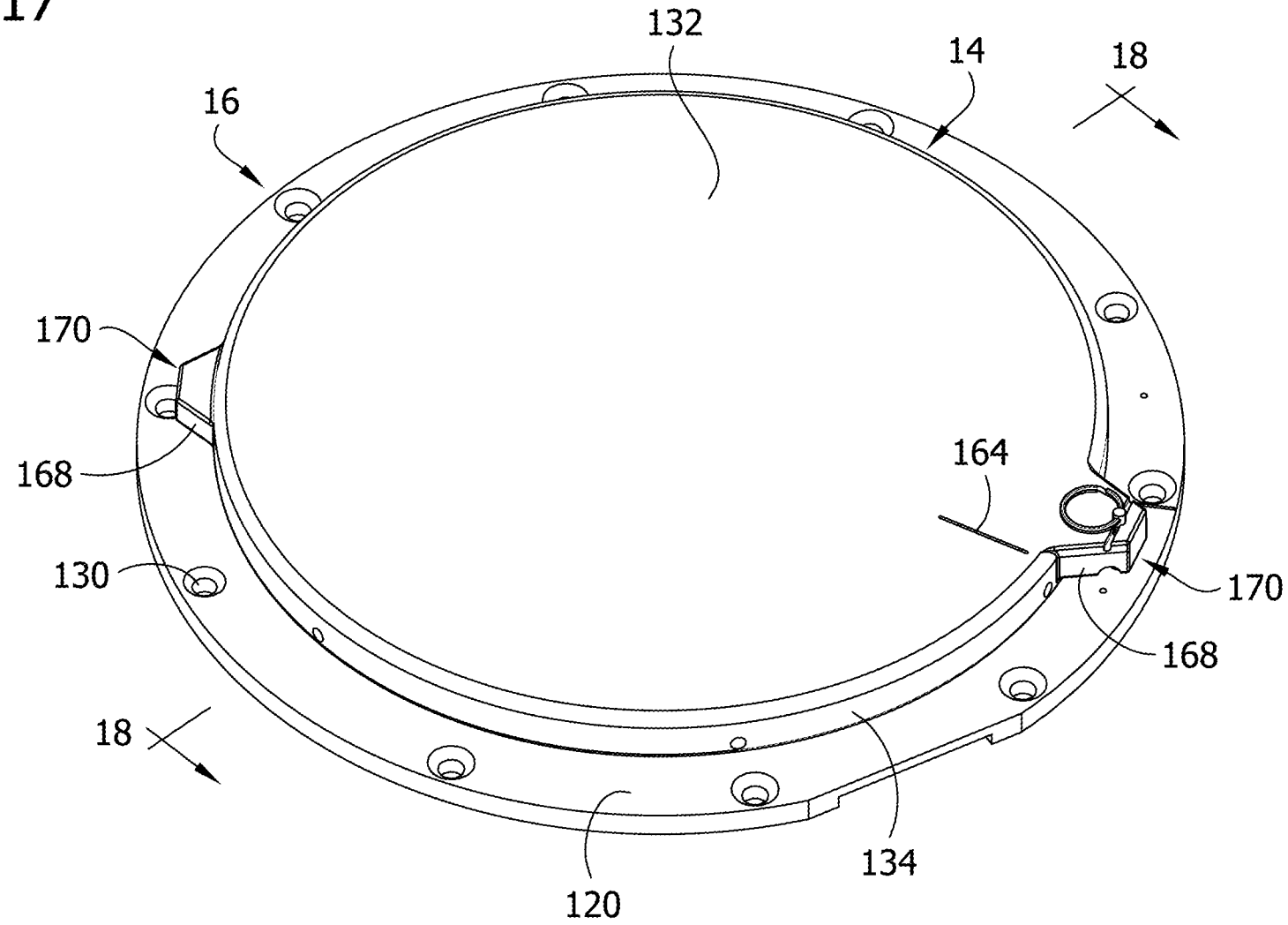
FIG. 17 is a perspective of the lid secured to the mouth.
Figure 18:
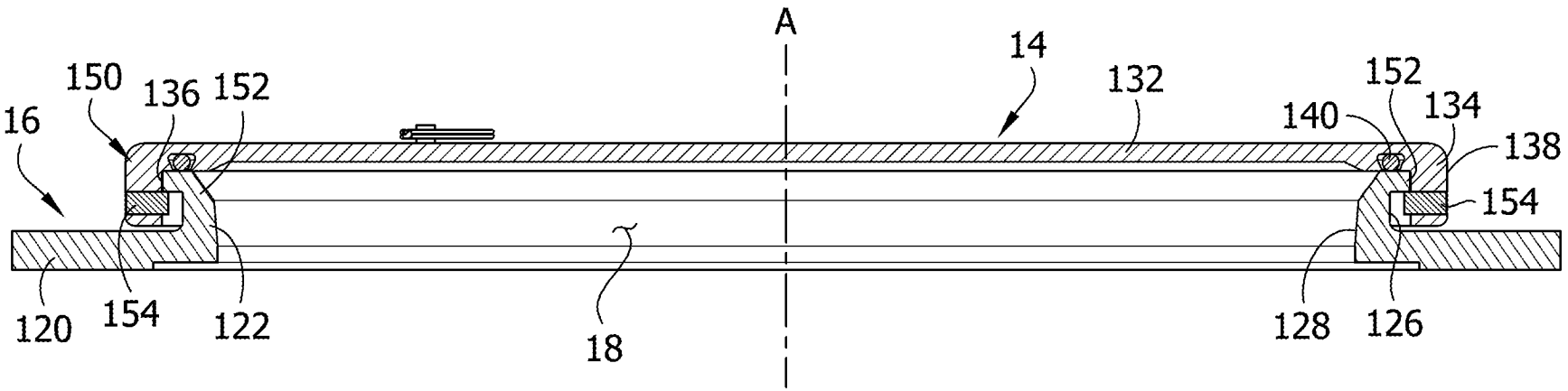
FIG. 18 is a section of the lid secured to the mouth taken through line 18-18 of FIG. 17.
Figure 19:
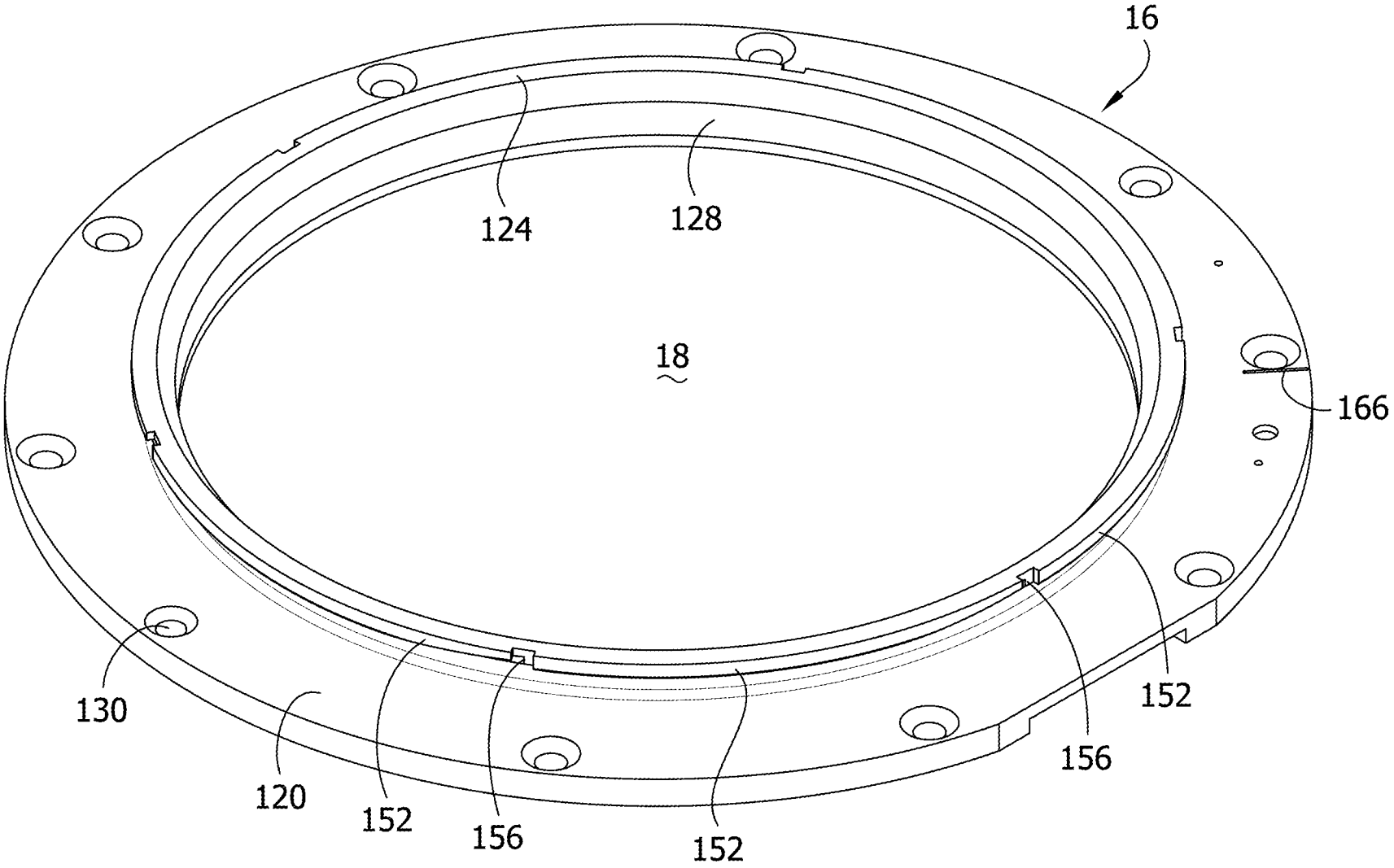
FIG. 19 is a perspective of the mouth.

With reference to FIGS. 16-18, a lid 14 for use with the container 10 (collectively, broadly, a "container system") will be described. Although FIG. 16 shows the container 10 schematically it will be understood the container 10 could be the same container described above (e.g., shown in FIGS. 1 and 2). For example, the lid 14 is shown in use on the valve 12 of the container 10 in FIG. 27. The container 12 has an interior sized and shaped to hold a material therein. As understood from the above discussion, in one example, the container 10 can be used to hold an oil additive known as phosphorous pentasulfide, a crystalline solid powder. It will be appreciated that the container 10 could be used for other purposes (e.g., carrying other materials). Moreover, the lid 14 could be used on other apparatus, and aspects of the lid could be used in other types of lids, without departing from the scope of the present invention.

In the illustrated embodiment, the container 10 has a generally rectangular shape, although the container can have other shapes. The container 10 includes a mouth 16. The mouth 16 defines (e.g., includes) an opening 18 in communication (e.g., fluid communication) with the interior. In the illustrated embodiment, opening 18 is generally circular. The materials pass into and out of the interior of the container 12 through the opening 18 in the mouth 16. In one embodiment, the mouth 16 may be part of a valve, such as gate valve 12, but the mouth 16 could be considered separate from and connected to the valve 12. The lid 14 is releasably secured to the mouth 16 to cover the opening 18. It is understood aspects of the mouth 16 and lid 14 could be used in other types and configurations of containers and lids, without departing from the scope of the present disclosure. For example, the lid 14 can be used on a mouth of a valve or a valved container such as shown and described above.

Referring to FIGS. 17-21, the mouth 16 includes a mouth axis A, a base or ring 120, and a circumferential wall 122 (e.g., side wall). The wall 122 has a generally cylindrical shape. The wall 122 extends from an inner circumferential edge of the base 120 to a free end. The free end of the wall 122 includes a sealing surface 124. The wall 122 has an outer surface 126 and an inner surface 128. The inner surface 128 generally defines the opening 18. The portion of the inner surface 128 adjacent the sealing surface 124 may be chamfered or filleted, as shown in the illustrated embodiment. In the illustrated embodiment, the base 120 includes fastener openings 130 circumferentially spaced part thereon. Each fastener opening 130 receives a fastener (not shown), such as a bolt, to attach the mouth 16 to a body of the container 10.

Figure 22:
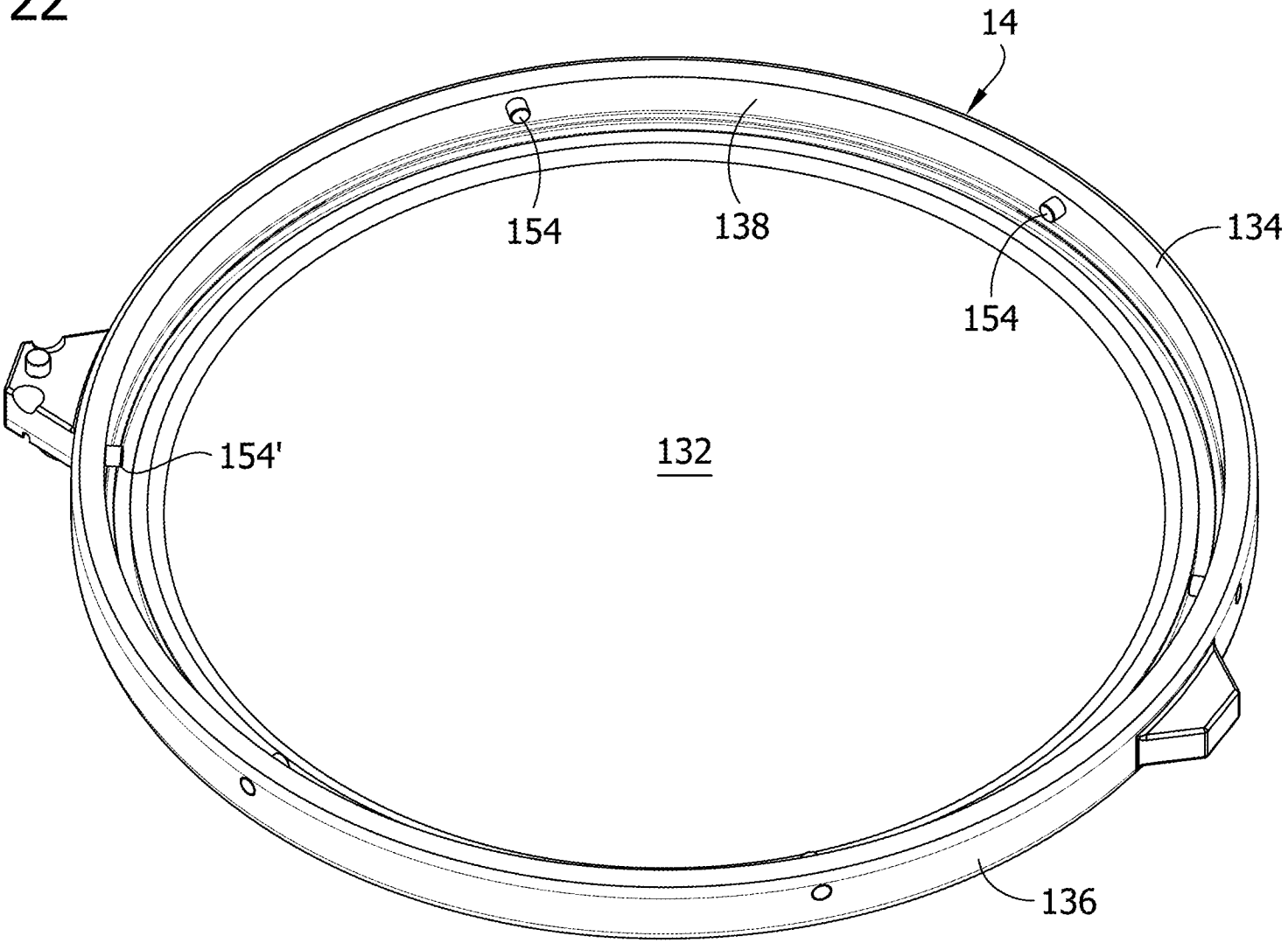
FIG. 22 is a bottom perspective of the lid.

Referring to FIGS. 17, 18 and 22, the lid 14 is sized and shaped to cover the opening 18. The lid 14 includes a base or cover 132 and a circumferential wall 134. The cover 132 is generally disk shaped. The wall 134 (broadly, "collar") has a generally cylindrical shape. The wall 134 extends from an outer circumferential edge of the cover 132 to a free end. The wall 134 has an outer surface 136 and an inner surface 138. The wall 134 of the lid 14 is sized and shaped to extend around the wall 122 of the mouth 16. Thus, when the lid 14 is attached to the mouth 16, the wall 122 of the mouth is disposed radially inboard of the wall 134 of the lid (FIG. 18).

Desirably, the lid 14 forms a sealed connection (e.g., fluid tight seal) with the mouth 16 when the lid is mounted on and secured to the mouth. The container system 10 may include a sealer 140 configured to be disposed between and engage the lid 14 and the mouth 14 when the lid is secured to mouth. The sealer 140 facilitates the formation of the fluid tight seal between the lid 14 and the mouth 16. The sealer 140 may be a gasket, O-ring or any other suitable device. In the illustrated embodiment, the sealer 140 is carried by the lid 14, and is disposed within a circumferential channel of the cover 132, adjacent the wall 134. The sealer 140 is compressed between and against the cover 132 and the sealing surface 124 of the mouth 16 to facilitate the formation of the fluid tight seal (FIG. 18).

Referring to FIGS. 18-23, the container system 10 includes a closure, generally indicated at 150 (broadly, "closure structure"), configured to releasably attach the lid 14 to the mouth 16. The closure 150 includes a plurality of retainers 152 and a plurality of catches 154. The retainers 152 and catches 154 engage each other to secure the lid 14 to the mouth 16. The retainers 152 are arranged on one of the mouth 14 or the lid 16 and the catches 154 are arranged on the other one of the mouth or the lid. Thus, the lid 14 and mouth 16 each include a part of the closure 150 and these parts (e.g., retainers 152 and catches 154) interact with one another to couple the lid and mouth together. For example, the arrangement can be described as permitting the lid 14 to be screwed onto the container 10. In the illustrated embodiment, the retainers 152 are arranged on (e.g., are part of) the mouth 16 and the catches 154 are arranged on (e.g., are part of) the lid 14. In another embodiment (not shown), the catches 154 are arranged on the mouth 16 and the retainers 152 are arranged on the lid 14. The following description describes the retainers 152 on the mouth 16 and the catches 154 on the lid 14 as shown in the illustrated embodiment, with the understanding the teachings described herein apply equally to and could be used in the embodiment where the catches are on the mouth and the retainers are on the lid.

Figure 20:
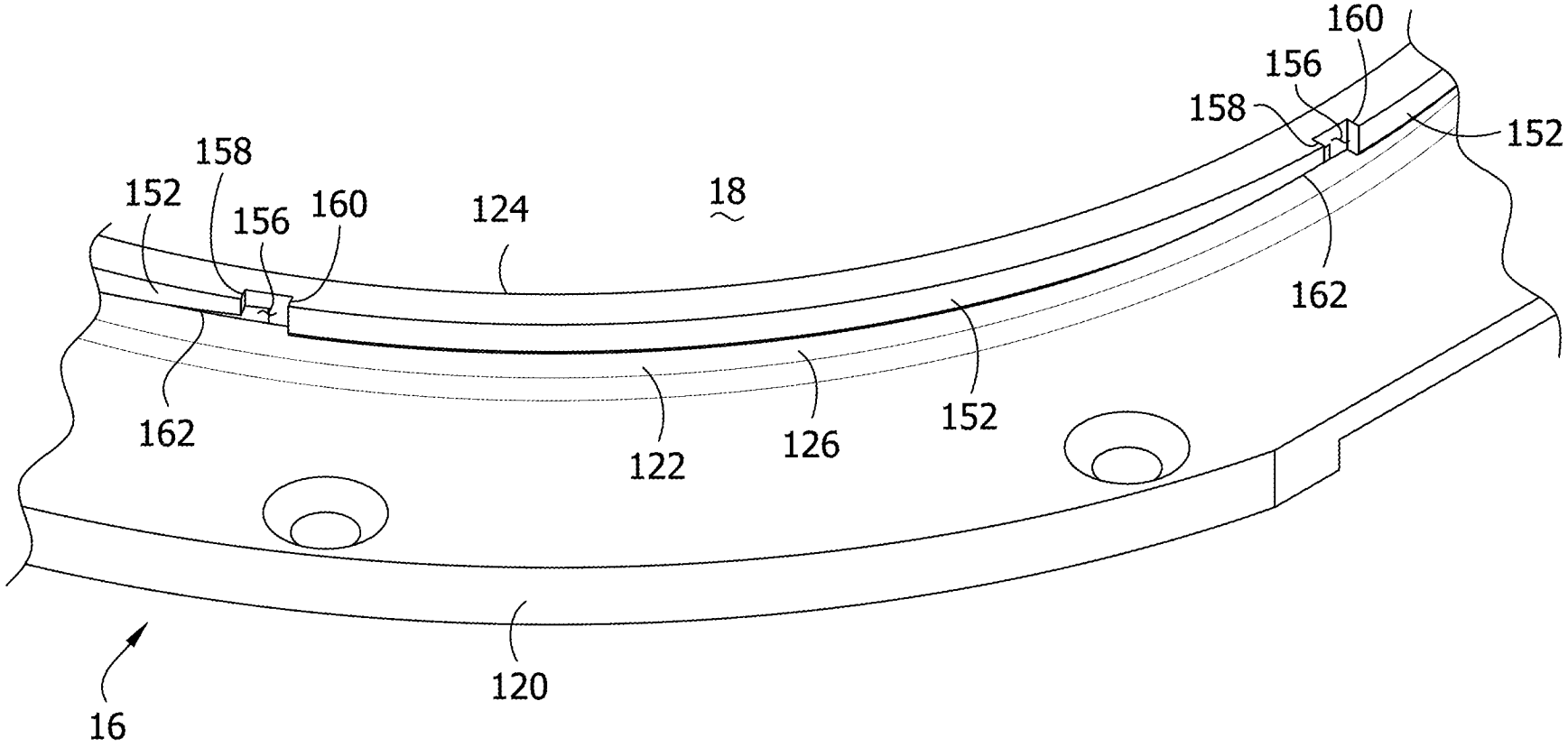
FIG. 20 is an enlarged fragmentary perspective of the mouth.
Figure 21:
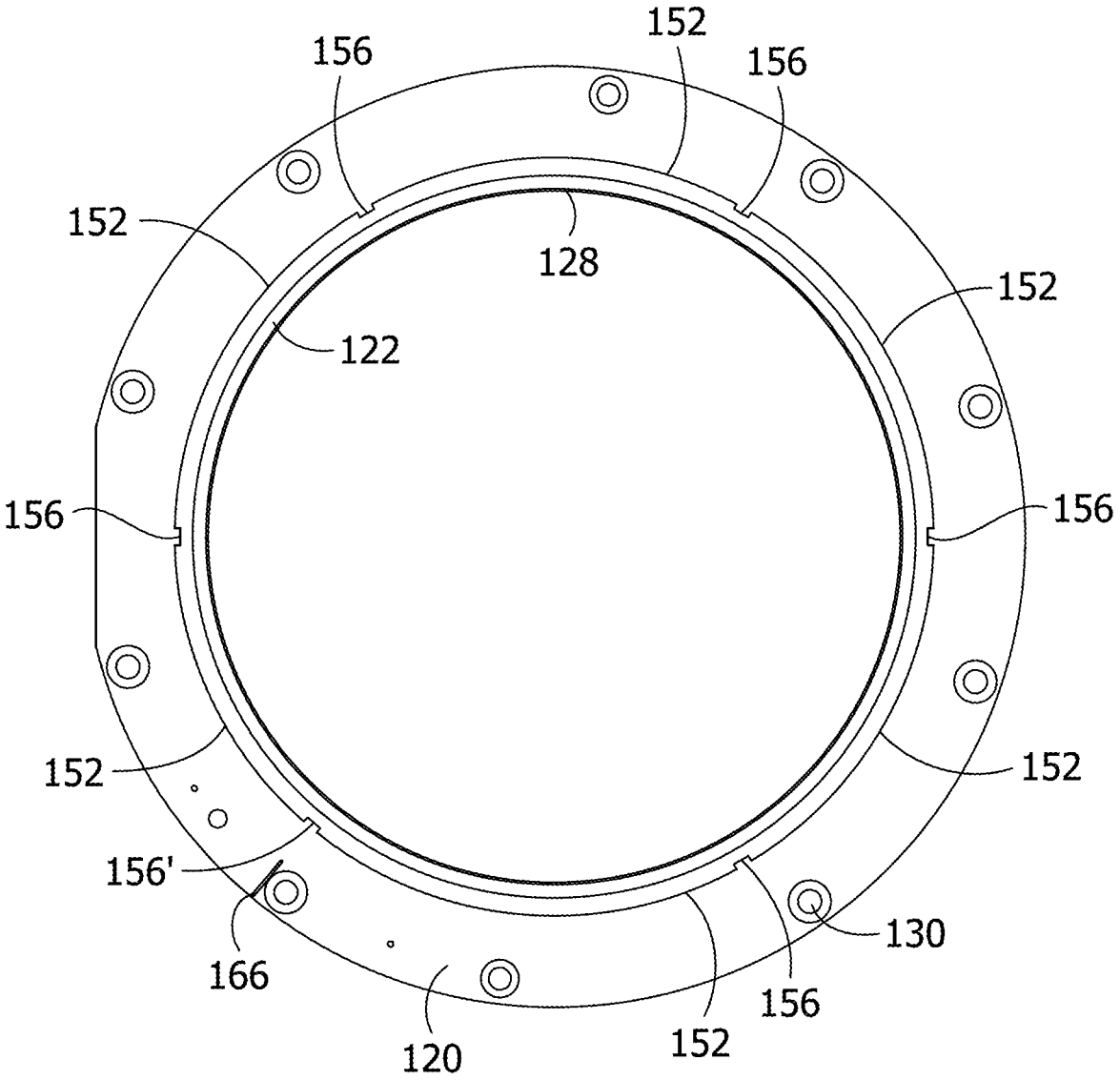
FIG. 21 is a top view of the mouth.

The retainers 152 are circumferentially arranged on the mouth 16. The retainers 152 are spaced apart (e.g., circumferentially spaced apart) from one another to define a plurality of gaps 156. Each gap 156 is disposed between two adjacent retainers 152. In the illustrated embodiment, there are six retainers 152 and six gaps 156, although more or fewer retainers and gaps are within the scope of the present disclosure. Each gap 156 has an open front, with opposite sides defined by the two adjacent retainers 152 and a back defined by the wall 122. The retainers 152 are arranged on the outer surface 126 of the wall 122. Each retainer 152 extends radially outward from the outer surface 126. The retainers 152 are generally disposed at or adjacent to the free end (e.g., sealing surface 124) of the wall 122. Each retainer 152 is generally elongate and extends circumferentially along the wall 22. Referring to FIG. 20, each retainer 152 has opposite first and second ends 158, 160. The first end 158 is generally narrow or thin (e.g., a narrow or thin end) and the second end 160 is generally tall or thick (e.g., a tall or thick end), relative to one another. The first end 158 has a height that is less than the height of the second end 160, the heights extending generally parallel to the axis A. Each retainer 156 includes a ramp 162 (e.g., a ramp surface). The ramp 162 is configured to be engaged by one of the catches 154 to secure the lid 14 to the mouth 16. The ramp 162 generally extends circumferentially along the wall 122. The ramp 162 extends from the first end 158 toward the second end 160. In the illustrated embodiment, the end of the ramp 162 opposite the first end 158 is disposed between the first and second ends 158, 160. In other embodiments, the ramp 162 may extend all the way to the second end 160. The ramp 162 gradually tapers as the ramp extends from the first end 158 toward the second end 160. The ramp 162 tapers downward (e.g., in a direction (proximal direction) extending from the sealing surface 124 to the base 120 that is generally parallel to the axis A). Accordingly, the height of the ramp 162 (e.g., retainer 152) increases as the ramp extends from the first end 158 toward the second end 160. The retainers 152 are generally arranged end-to-end about the axis A on the wall 122. Thus, in the illustrated embodiment, the retainers 152 cooperate to define a discontinuous circumferential lip of the mouth 16 that is broken up by the gaps 156.

Figure 23:
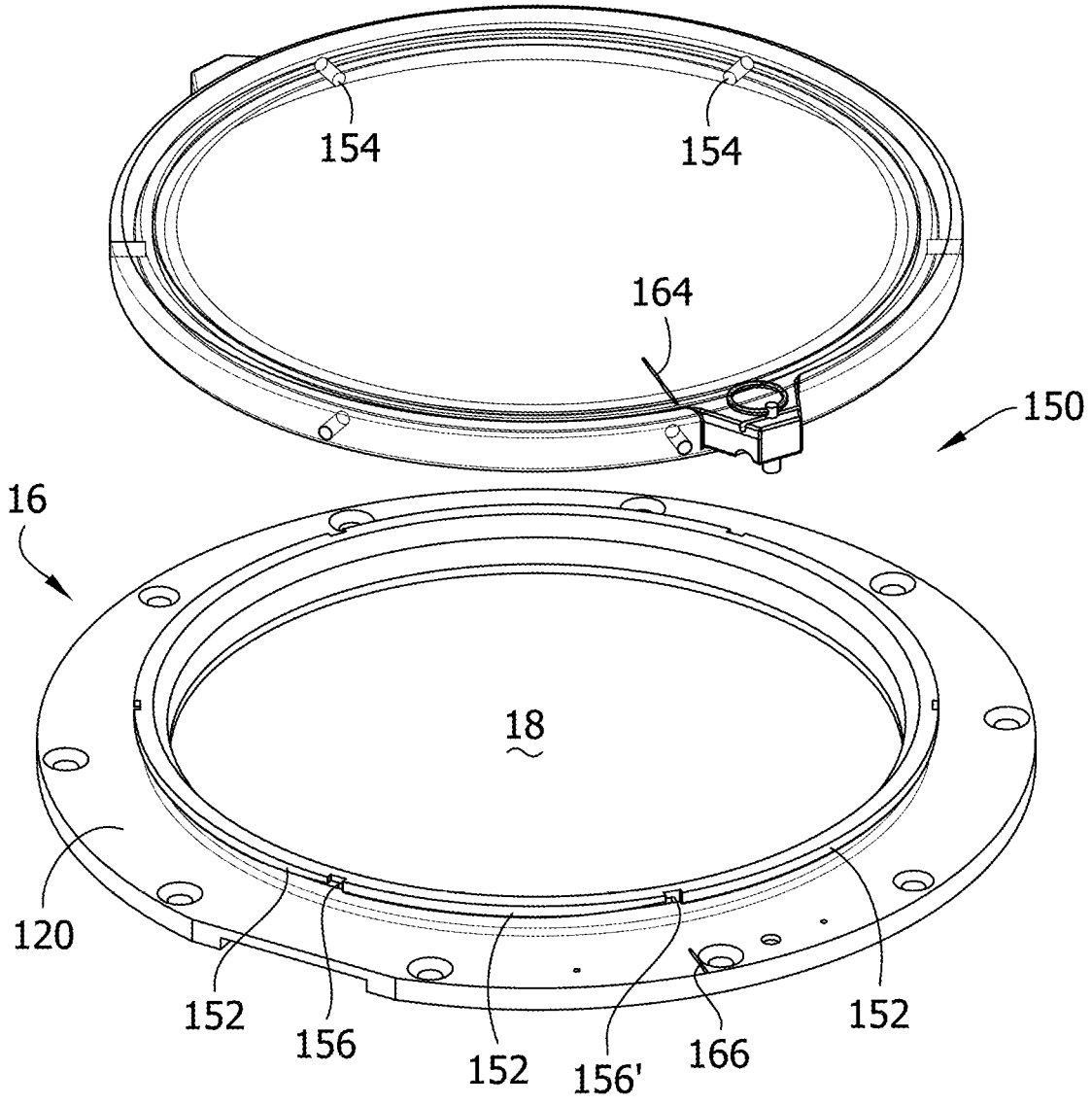
FIG. 23 is a perspective of the lid spaced apart from and in registration with the mouth, portions of the lid shown as transparent to show details otherwise hidden from view.

The catches 154 are circumferentially arranged on the lid 14. The catches 154 are spaced apart (e.g., circumferentially spaced apart) from each other on the lid 14 (e.g., wall 134). Each catch 154 is arranged or disposed on the lid 14 so that it can pass through one of the gaps 156 when the lid is mounted on the mouth 16, as shown in FIG. 23. Thus, there are six catches 154 corresponding to the six gaps 156, although more or fewer catches are within the scope of the present disclosure. It is understood the closure 150 will desirably have the same number of catches 154, retainers 152 and gaps 156. The catches 154 are arranged on the inner surface 138 of the wall 134. Each catch 154 extends radially inward from the inner surface 138. In the illustrated embodiment, the catches 154 comprise lugs having a generally circular cross sectional shape, although other shapes are within the scope of the present disclosure. The catches 154 are spaced apart from the base 132. The distance between the catches 154 and the base 132 is greater than the height of the first end 158 of the retainers 152.

The lid 14 is rotated relative to the mouth 16 (broadly, "screwed onto" the mouth) to secure the lid to the container 12, after the lid is received on the mouth by moving the catches 154 through the gaps 156. Each catch 154 is configured to engage one of the retainers 152 when the lid 14 is rotated relative to the mouth 16 to secure the lid to the mouth. As the lid 14 is rotated, the catches 154 move circumferentially between the first ends 158 of the retainers 152 and the base 120 and toward the second ends 160. The catches 154 generally ride or slide along the ramps 162 of the retainers 152 as the lid 14 is rotated. This compresses the sealer 140 between the lid 14 and the sealing surface 124 to form a fluid tight seal therebetween. The ramps 162 have a height (e.g., a height at some point along their length) that is greater than the distance between the catches 154 and the cover 132 (more broadly, a height from the sealing surface 124 to the ramp surface that is greater than the distance between the catches and the cover). Accordingly, as the lid 14 continues to rotate relative to the mouth 14, the catches 154 will engage and bind against the retainers 152 (e.g., ramps 162), thereby securing the lid on the mouth.

Desirably, the distance between the catches 156 and the cover 132 is less than the height of the second end 160 of the retainers 152, to inhibit the catches 156 from moving past the second end and limit the rotation of the lid 14. In this manner, the second end 160 of the retainers 152 are stops that limit and inhibit the rotation of the lid 14. Thus, the lid 14 can only be turned in one direction (e.g., clockwise) when the lid is mounted on the mouth 16 to secure the lid to the mouth. Likewise, the second ends 60 of the retainers 152 limit and stop the rotation of the lid 14 when the lid is being rotated (e.g., rotated in the opposite direction (i.e., counter-clockwise)) to remove the lid from the mouth. This aligns the catches 154 with the gaps 156 to enable the lid 14 to be more easily removed from (e.g., lifted off) the mouth 16.

The lid 14 can be secured to (and removed from) the mouth 16 by rotating the lid less than about 360 degrees about the axis A (e.g., less than about one turn). Desirably, the lid 14 can be secured to the mouth 16 by rotating the lid less than about 180 degrees, more desirably less than about 90 degrees, more desirably less than about 60 degrees, more desirably less than about 45 degrees, more desirably less than about 30 degrees, even more desirably within an inclusive range of about 10 degrees to 30 degrees (e.g., by about 20 degrees). Reducing the amount of rotation makes securing and removing the lid 14 to the mouth 16 easier and faster.

The closure 150 is configured to allow the lid 14 to be mounted on the mouth 16 only when the lid and mouth are in a specific orientation relative to each other. In other words, the closure 150 is configured such that only one clocked orientation of the lid 14 and the mouth 16 (relative to each other) enables the lid to be mounted on the mouth. As shown in FIG. 23, to mount the lid 14 on the mouth 16, the catches 154 and gaps 156 must be aligned. In the illustrated embodiment, the catches 154 and gaps 156 are each asymmetrically arranged (e.g., have an asymmetrical circumferential arrangement). This asymmetrical arrangement limits the mounting of the lid 14 on the mouth 16 to the one orientation. It is understood that the catches 154 and gaps 156 have the same asymmetrical arrangement so that the catches and gaps can be aligned in order to insert the lid 14 on and remove the lid from the mouth 16. Specifically, the catches 154 and gaps 156 are asymmetrically arranged about the axis A. The catches 154 have an asymmetrical circumferential arrangement on the wall 134 of the lid 14. Likewise, the gaps 156 have an asymmetrical circumferential arrangement on the wall 122 of the mouth 16.

The asymmetrical circumferential arrangement of the catches 154 and gaps 156 enables the lid 14 to be mounted on the mouth 16 when the lid and mouth are in only one orientation relative to one another. In the illustrated embodiment, five of the catches 154 and gaps 156 are generally evenly (e.g., symmetrically) arranged (e.g., spaced apart) about the axis A, with the remaining one of the catch and gap being unevenly arranged about the axis to create the asymmetrical arrangement. In the illustrated embodiment, the unevenly arranged catch and gap are each designated by a trailing prime—i.e., catch 154' and gap 156'. In the illustrated embodiment, the evenly spaced apart catches 154 and gaps 156 are spaced apart about the axis A by approximately 60 degrees with the unevenly spaced apart catch 154' and gap 156' being spaced apart about the axis from the evenly spaced apart catches or gaps on either side thereof by approximately 70 degrees and about 50 degrees, respectively. Once aligned, the lid 14 is moved toward the mouth 16 with the catches 154 passing through the gaps 156 between the retainers 152. Once the catches 154 move through the gaps 156, the lid 14 is rotated to secure the lid to the mouth 16. Other configurations of closures (e.g., other catches, retainers, and/or gaps), such as symmetrical arrangements, are within the scope of the present disclosure.

To help an operator align the lid 14 and mouth 16 in the singular orientation, the lid and mouth may include indicia 164, 166 (e.g., alignment indicia). Indicia 164 is on the lid 14 and indicia 166 is on the mouth 16. The indicia 164, 166 indicates the specific orientation of the lid 14 and mouth 16 these elements must be in relative to each other to mount the lid on the mouth and remove the lid from the mouth. In the illustrated embodiment, the indicia 164, 166 are linear lines or grooves that are aligned (e.g., radially aligned) when the lid 14 and mouth 16 are in the proper orientation. Other configurations of the indicia are within the scope of the present disclosure.

Figure 27:
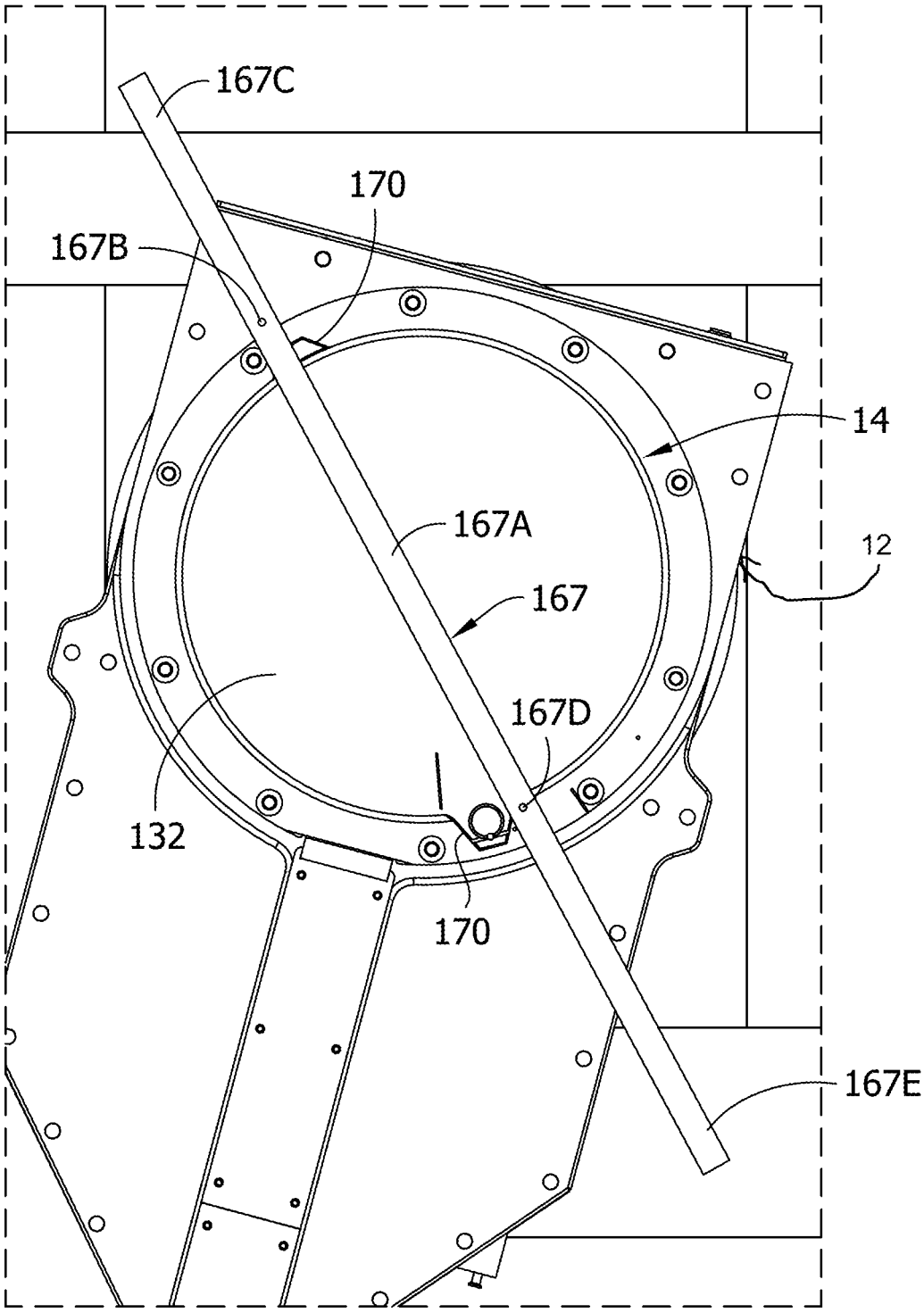
FIG. 27 is a perspective of the container system with an installation tool on the lid for rotating the lid.

Referring to FIG. 17, and to FIG. 27, the lid 14 is configured to be engaged by a tool 167, such as a spanner wrench, to rotate the lid. The tool 167 may be used to secure and remove the lid 14 from the mouth 16. The lid 14 includes two shoulders 168 (broadly, tool engagement portions or tool receivers) on generally opposite sides of the lid 14 configured to be engaged by the tool 167. The lid 14 includes two tabs or projections 170 on generally opposite sides of the lid. Each projection 170 includes (e.g., defines) one of the shoulders 168. Rotation of the lid 14 toward the closed or open positions with respect to the mouth 16 can be done using the tool 167. Such a spanner wrench could include an elongate body 167A having a first protrusion 167B (broadly, a first head) at a first end portion, a first handle 167C outboard of the first protrusion, a second protrusion 167D (broadly, a second head), and a second handle 167E outboard of the second protrusion. The first and second protrusions 167B, 167D extend downward from the elongate body 167A and are engaged with shoulders 168 of the lid 14 such that manual force on the handles 167C, 167E tending to turn the tool about the axis A rotates the lid 14.

The retainers 152 and catches 154 can be a unitary, one-piece component (formed integrally) with the mouth 16 and lid 14, respectively, or the retainers and catches can be separate components joined to the mouth and lid, respectively, such as by welding. For example, in the illustrated embodiment, the retainers 152 are integral with the mouth 16 and the catches 154 are separate components joined to the lid 14. In embodiment, the lid 14, mouth 16 and closure 150 are made from metal (e.g., stainless steel, aluminum, etc.), although other suitable materials are within the scope of the present disclosure.

Figure 24:
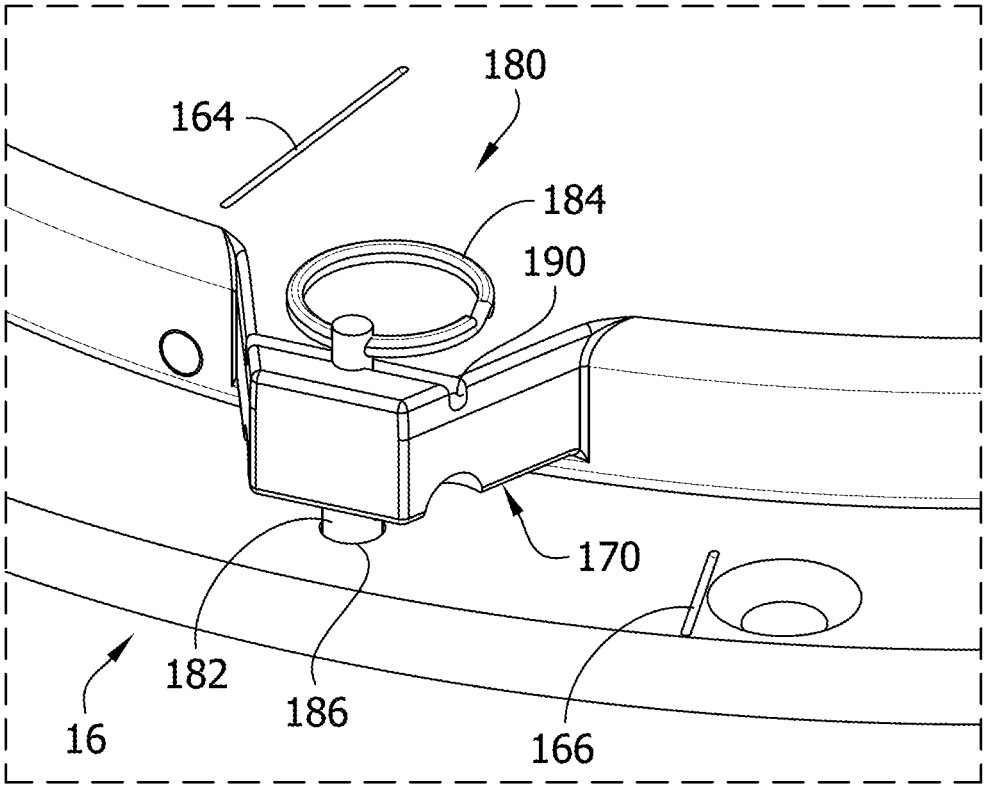
FIG. 24 is a perspective of a locker of the lid in a locked position.
Figure 25:
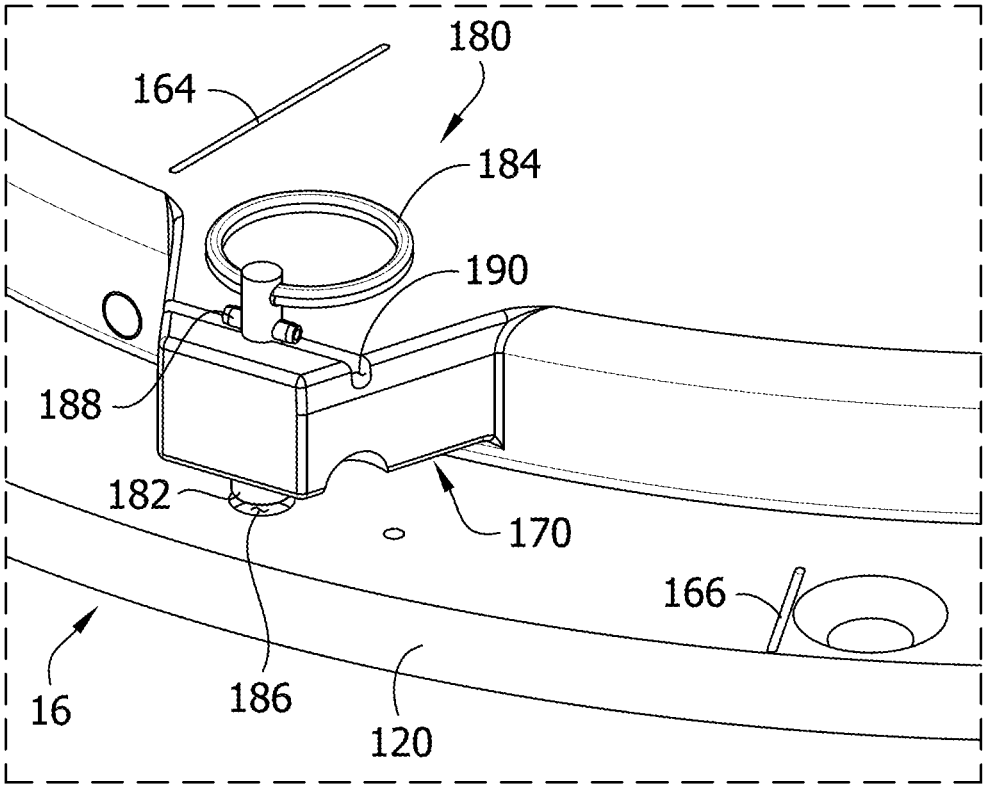
FIG. 25 is a perspective of the locker in a first unlocked position.
Figure 26:
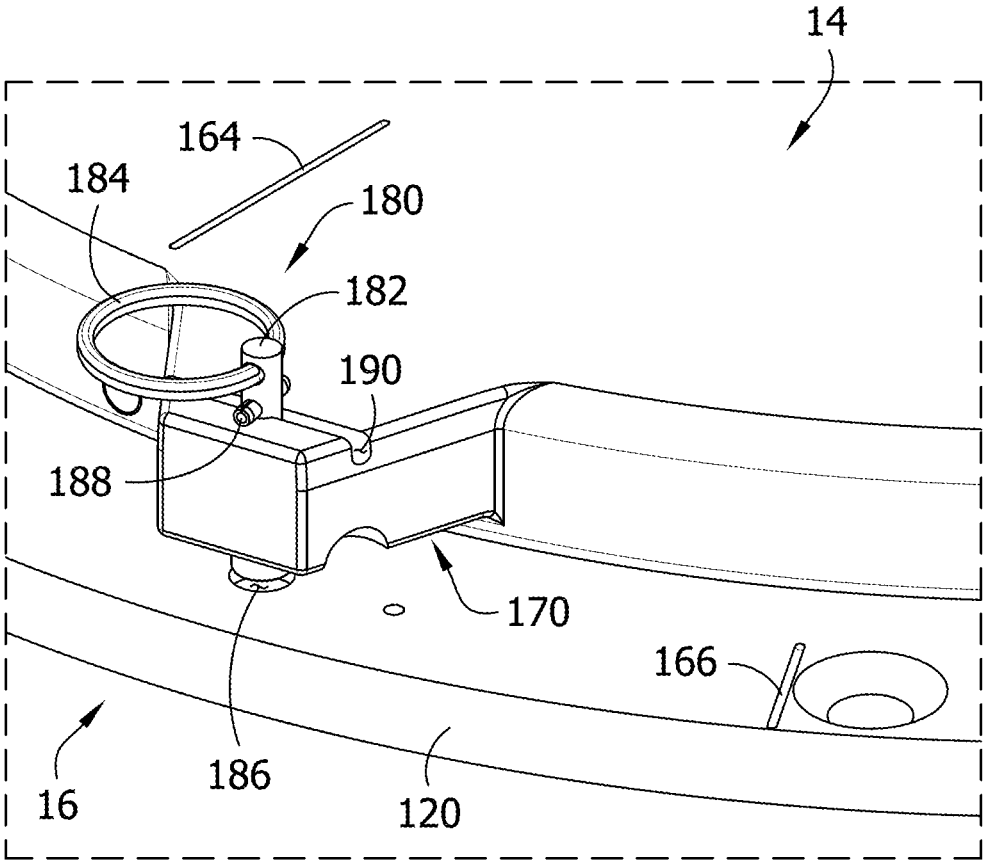
FIG. 26 is a perspective of the locker in a second unlocked position.

Referring to FIGS. 24-26, the lid 14 includes a locker 180 to inhibit the lid from rotating relative to the mouth 16. Specifically, the locker 180 is configured to inhibit the lid 14 from unintentionally rotating open, thereby becoming loose from the mouth 16, losing the fluid light seal between the lid and mouth and/or disconnecting from (e.g., falling off) the mouth. The locker 180 is moveable between a locked position (FIG. 24) and a unlocked position (see generally, FIGS. 25 and 26). In the locked position, the locker 180 inhibits the lid 14 from moving (e.g., rotating) relative to the mouth 16. In this position, the locker 180 is generally engaged with (e.g., captured by) the mouth 16 of the container 12 to inhibit movement. In the unlocked position, the locker 180 permits the lid 14 to move (e.g., rotate) relative to the mouth 16. In this position, the locker 180 is generally disengaged from (e.g., spaced apart from, not captured by) the mouth 16 of the container 12 to permit movement.

In the illustrated embodiment, the locker 180 comprises a locking pin. The locker 180 includes a pin or dowel 182 moveable between the locked and unlocked positions. The pin 182 is generally cylindrical and elongate with opposite first and second ends (e.g., distal and proximal ends). The locker 182 includes a handle 184 adjacent the first end. The operator grasps the handle 184 to move the locker 180 between the locked and unlocked positions. In the illustrated embodiment, the handle 184 is a ring (e.g., a key ring), although other configurations of the handle are within the scope of the present disclosure. The mouth 16 includes a recess 186 sized and shaped to receive the locker 180 when the locker is in the locked position. The locker 180 extends into the recess 186 when the locker is in the locked position. Specifically, the recess 186 is sized and shaped to receive the second end of the pin 182 when the pin is in the locked position. The engagement between the pin 182 and the edges defining the recess 186 inhibits the lid 14 from rotating relative to the mouth 16. In the illustrated embodiment, the base 20 includes the recess 186. The pin 182 is slidably mounted within a generally cylindrical opening in the lid 14. In the illustrated embodiment, the cylindrical opening is in one of the projections 170. The pin 182 is moved proximally (e.g., toward the base 120) in the cylindrical opening to position the locker 180 in the locked position and distally (e.g., away from the base) in the cylindrical opening to position the locker in the unlocked position.

In one embodiment, the locker 180 is resiliently biased toward the locked position. The locker 180 may include a spring resiliently biasing the locker toward the locked position. For example, the spring may be a coil spring surrounding a portion of the pin 182 and extending between an underside of the projection 170 and a shoulder of the pin adjacent the second end.

The locker 180 may also include a keeper 188 configured to hold the locker in the unlocked position. The keeper 188 engages the upper surface of the projection 170 to hold the locker in the unlocked position (FIG. 26). In the illustrated embodiment, the keeper 188 is a pin or dowel extending generally transversely to the pin 182. The projection 170 defines a depression or channel 190 which can receive the keeper 188 to permit the locker 180 to move to the locked position. The locker 180 (e.g., pin 182) can be rotated in the cylinder opening of the projection 170 by the operator to move the keeper 188 into and out of alignment with the channel 190. In a first or non-holding unlocked position (FIG. 25), the keeper 188 is aligned with the channel 190. In this position, the operator must continue to hold the locker 180 to prevent the locker from moving toward the locked position. In a second or holding unlocked position (FIG. 26), the keeper 188 is not aligned with the channel 190. In this position, the keeper 188 engages the upper surface of the projection 170 which inhibits the locker 180 from moving toward the locked position. Thus, the operator does not need to hold the locker in this unlocked position. The locker 180 can be rotated at generally any angle to misalign the keeper 188 with the channel from the orientation shown in FIG. 25, such as about 90 degrees.

In operation, to attach the lid 14 to the mouth 16, the operator orients the lid relative to the mouth so that the catches 154 are aligned with the gaps 156. The operator may use the indicia 164, 166 to help align the lid 14 and mouth 16. The specific orientation of the lid 14 and mouth 16 ensures that the locker 180 will be aligned with the recess 186 when the lid is secured to the mouth. Once aligned, the operator mounts the lid 14 on the mouth 16. The operator positions the lid 14 over the mouth 16 by inserting the catches 154 through the gaps 156. The lid 14 is then rotated in a first direction relative to the mouth 16 which moves the catches 154 along the retainers 152. As the lid 14 is rotated, the catches 154 engage the retainers 152 (e.g., ramps 62) to secure the lid to the mouth 16. The engagement with the catches 154 moves the lid 14 proximally until the lid 14 and/or the sealer 140 engage the sealing surface 124 of the mouth 16. In this position, the lid 14 is generally inhibited from further rotation in the first direction (e.g., clockwise rotation) and is secured to the mouth 16. In addition, the locker 180 is generally aligned with the recess 186 in the base 120 of the mouth 16 and moves into the locked position by extending into the recess due to the biasing of the spring. The locker 180 can be moved to the unlocked position by the operator before mounting the lid 14 on the mouth 16, or more desirably, the operator simply allows the locker to move toward the unlocked position when the lid is mounted on the mouth. In this method of operation, the second end of the pin 182 engages the base 120 when the lid 14 is mounted on the mouth 16, moving the locker toward the release position. The engagement between the second end of the pin 182 and the base 120 generally keeps the locker 180 in the unlocked position as the locker rides on the base until the lid 14 is rotated far enough such that the pin is aligned with the recess 186, at which point the spring pushes the locker into the recess (e.g., the locked position).

To remove the lid 14 from the mouth 16, the operator moves the locker 180 to the unlocked position. Desirably, the operator moves the locker 180 into the holding unlocked position (e.g., moves the keeper 188 out of alignment with the recess 190) so that the keeper holds the locker in the unlocked position as the lid is removed. However, the operator could simply hold the locker 180 in the non-holding release position. When the locker 180 is in the unlocked position, the lid 14 is free to be rotated in a second direction (e.g., counter-clockwise) until the catches 154 align with the gaps 156. The catches 154 may contact the second ends 160 of the retainers 152, thereby stopping further rotation in the second direction of the lid 14 and aligning the catches with the gaps 156. When the catches 154 and gaps 156 are aligned, the lid 14 is lifted off the mouth 16. As the lid 14 is lifted, the catches 154 move through the gaps 156.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A container system configured to hold phosphorous pentasulfide, the container system comprising:

a container body comprising an interior sized and shaped to hold the phosphorous pentasulfide;

a mouth supported by the container body, the mouth defining a mouth opening for communication with the interior of the container body;

a valve supported by the container body, the valve including a gate, a drive shaft, and a race, the drive shaft being rotatable to selectively move the gate in a first direction to permit communication between the mouth and the interior of the container body and to selectively move the gate in a second direction to block communication between the mouth and the interior of the container body, the race secured to the drive shaft by a roll pin for conjoint rotation with the drive shaft when the drive shaft is rotated, the roll pin extending through a bore of the drive shaft and into openings in the race; and a lid for closing the mouth, the lid being configured to screw onto the mouth to connect the lid and mouth to close the mouth to block the mouth opening, wherein the lid comprises a locker, the locker being configured to obstruct disconnection of the lid and mouth.

2. A container system as set forth in claim 1, wherein the locker is configured to automatically obstruct disconnection of the lid and mouth upon screwing the lid onto the mouth.

3. A container system as set forth in claim 2, wherein the locker is movable between a locking position to obstructs the disconnection of the lid and mouth and an unlocking position to permit the disconnection of the lid and mouth, wherein the locker is resiliently biased toward the locking position.

4. A container system as set forth in claim 3, wherein the mouth includes a recess sized and shaped to receive the locker, the locker extending into the recess when the locker is in the locked position.

5. A container system as set forth in claim 4, wherein the locker includes a spring resiliently biasing the locker toward the locked position.

6. A container system as set forth in claim 5, wherein the locker includes a keeper to hold the locker in the unlocked position.

7. A container system as set forth in claim 1, wherein the lid is configured to be engaged by a tool to turn the lid to screw the lid onto the mouth.

8. A container system as set forth in claim 7, wherein the lid comprises at least one tool receiver on which the tool is receivable to turn the lid.

9. A container system as set forth in claim 8, wherein the at least one tool receiver comprises a first tool receiver and a second tool receiver located on opposing sides of the lid.

10. A container system as set forth in claim 7, in combination with the tool, wherein the tool comprises a first lid engagement head and a second lid engagement head, the first lid engagement head being spaced apart from the second lid engagement head such that the first and second lid engagement heads are arranged to engage the lid at different locations on the lid.

11. A container system as set forth in claim 1, wherein the lid is configured to form a seal with the mouth.

12. A container system as set forth in claim 1, wherein the lid includes a collar configured to be received over the mouth when the lid is screwed onto the mouth.

13. A container system as set forth in claim 1, further comprising a plurality of retainers circumferentially arranged on one of the mouth or the lid, the retainers circumferentially spaced apart to define a plurality of gaps, each gap disposed between adjacent retainers, and further comprising a plurality of catches circumferentially arranged on the other one of the mouth or the lid, each catch arranged to pass through one of the gaps to screw the lid on the mouth and arranged to engage one of the retainers when the lid is rotated relative to the mouth to screw the lid on the mouth.

14. A container system as set forth in claim 1, wherein the lid comprises a cover and a circumferential wall extending from the cover, the wall having an inner surface, the lid further comprising a plurality of catches extending radially inward from the inner surface of the wall, the catches being circumferentially spaced apart on the wall, and the lid comprising a locker to inhibit the lid from rotating relative to the container, the locker being moveable between an unlocked position and a locked position.

15. A container system as set forth in claim 1, wherein the mouth comprises a base and a circumferential wall extending from the base, the wall having an outer surface and an inner surface, the inner surface defining a mouth opening, and the mouth comprising a plurality of retainers circumferentially arranged on the outer surface of the wall, the retainers circumferentially spaced apart to define gaps between adjacent retainers, the retainers and gaps having an asymmetrical circumferential arrangement on the wall.

16. A lid for a phosphorous pentasulfide container, the lid comprising:

a cover including a body, a circumferential wall extending from the body and having an inner surface and an opposing outer surface, a plurality of catches extending radially inward from the inner surface of the circumferential wall, the plurality of catches being circumferentially spaced apart on the circumferential wall, and a plurality of projections extending radially away from the outer surface of the circumferential wall, the body, the circumferential wall, the plurality of catches, and the plurality of projections of the cover integrally formed of the same piece of material, and at least one projection of the plurality of projections having a surface defining a channel; and a locker configured to inhibit the lid from rotating relative to the container, the locker including a first pin being moveable between an unlocked position and a locked position and a second pin extending traverse to the first pin, the second pin movable to align with the channel of the projection to permit the first pin to move to the locked position and to misalign with the channel of the projection to inhibit the first pin to move to the locked position, wherein in the unlocked position the first pin is positioned to be disengaged from the container when the cover is on the container, and wherein in the locked position the first pin is positioned to engage the container when the cover is on the container.

17. A lid as set forth in claim 16, wherein the plurality of catches have an asymmetrical circumferential spacing arrangement on the wall to limit connection between the lid and the container to one orientation.

18. A container system for holding a material, the container system comprising:

a container having an interior sized and shaped to hold the material, the container having a mouth defining a generally circular opening for communication with the interior;

a lid sized and shaped to block the opening; and a closure configured to releasably connect the lid and the mouth, the closure including a plurality of elongated retainers circumferentially arranged on one of the mouth or the lid, the elongated retainers circumferentially spaced apart to define a plurality of gaps, each elongated retainer having a first end, a second end opposing the first end, and a ramp surface extending between the first end and the second end, the first end and the second end of each elongated retainer extending different distances from the mouth or the lid, each gap disposed between the first end and the second end of adjacent elongated retainers, the closure including a plurality of catches circumferentially arranged on the other one of the mouth or the lid, each catch arranged to pass through one of the gaps to mount the lid on the mouth and arranged to engage one of the elongated retainers when the lid is rotated relative to the mouth to secure the lid to the mouth, the catches and gaps each having an asymmetrical circumferential arrangement to limit connection between the lid on the mouth to one orientation.

19. A mouth for a container for holding phosphorous pentasulfide, the mouth comprising:

a base;

a circumferential wall extending from the base, the wall having an outer surface and an inner surface, the inner surface defining a mouth opening; and a plurality of elongated retainers circumferentially arranged on the outer surface of the wall, the elongated retainers circumferentially spaced apart to define gaps, each elongated retainer having a first end, a second end opposing the first end, and a ramp surface extending between the first end and the second end, the first end and the second end of each elongated retainer extending different distances from the wall, each gap disposed between the first end and the second end of adjacent elongated retainers, the elongated retainers having an asymmetrical circumferential spacing arrangement on the wall to limit connection between the mouth and the container to one orientation.

* * * * *